US010039681B2

(12) United States Patent
Ballantyne et al.

(10) Patent No.: US 10,039,681 B2
(45) Date of Patent: Aug. 7, 2018

(54) ISOLATION METHOD AND APPARATUS

(71) Applicant: Care Strategic D.I.R. Holdings Pty. Ltd., Ninderry, Queensland (AU)

(72) Inventors: Justin Douglas Ballantyne, Ninderry (AU); James Edward Burkwood, Buderim (AU); Anna Louise Ballantyne, Ninderry (AU)

(73) Assignee: Care Strategic D.I.R. Holdings Pty. Ltd., Ninderry (AU)

( * ) Notice: Subject to any disclaimer, the term of this patent is extended or adjusted under 35 U.S.C. 154(b) by 0 days.

(21) Appl. No.: 15/698,433

(22) Filed: Sep. 8, 2017

(65) Prior Publication Data

US 2018/0021198 A1 Jan. 25, 2018

Related U.S. Application Data

(63) Continuation of application No. 15/352,225, filed on Nov. 15, 2016, now Pat. No. 9,782,314, which is a (Continued)

(30) Foreign Application Priority Data

Aug. 2, 2012 (AU) ..... 2012903331

(51) Int. Cl.
*E04B 1/34* (2006.01)
*A61G 10/00* (2006.01)
(Continued)

(52) U.S. Cl.
CPC ..... *A61G 10/005* (2013.01); *A61G 12/001* (2013.01); *E04B 1/34384* (2013.01);
(Continued)

(58) Field of Classification Search
CPC ..... E04H 15/44; E04H 15/46; E04H 15/48; E04H 15/50; E04H 15/52; E04H 15/505;
(Continued)

(56) References Cited

U.S. PATENT DOCUMENTS 3,028,871 A 4/1962 Clift, Jr.
3,526,066 A 9/1970 Hagar et al.
(Continued)

FOREIGN PATENT DOCUMENTS

CA 1276856 11/1990
CA 2556140 A1 2/2008
(Continued)

OTHER PUBLICATIONS

Horton Automatics Brochure, Negative, Positive & Combination Pressure Room Door Systems. Isolation Room Door Systems for Airborne Infection Control, 2011.

*Primary Examiner* — Chi Q Nguyen
(74) *Attorney, Agent, or Firm* — George C. Rondeau, Jr.; Davis Wright Tremaine LLP

(57) ABSTRACT

Apparatus for use in isolating a subject, the apparatus including a frame movable between collapsed and erected configurations, a body supported by the frame, wherein in the erected configuration, the body defines an internal volume for containing a subject to thereby substantially isolate the subject from a surrounding environment and a door actuator supported by the frame for moving a door between open and closed positions to thereby provide access to the internal volume.

16 Claims, 31 Drawing Sheets

Related U.S. Application Data continuation of application No. 14/418,901, filed as application No. PCT/AU2013/000846 on Aug. 1, 2013, now Pat. No. 9,534,407.

(51) Int. Cl.

| | |
|---|---|
| ***E04H 1/12*** | (2006.01) |
| ***E04H 3/08*** | (2006.01) |
| ***E04H 15/50*** | (2006.01) |
| ***A61G 12/00*** | (2006.01) |
| ***E04B 1/343*** | (2006.01) |
| ***E04B 1/348*** | (2006.01) |
| *E04H 15/48* | (2006.01) |
| *E04H 15/46* | (2006.01) |
| *E04H 15/44* | (2006.01) |
| *E04H 15/52* | (2006.01) |

(52) U.S. Cl.

CPC ..... *E04B 1/34869* (2013.01); *E04H 1/125* (2013.01); *E04H 1/1277* (2013.01); *E04H 3/08* (2013.01); *E04H 15/50* (2013.01); *E04B 1/34305* (2013.01); *E04B 1/34347* (2013.01); *E04B 1/34363* (2013.01); *E04B 1/34368* (2013.01); *E04H 15/44* (2013.01); *E04H 15/46* (2013.01); *E04H 15/48* (2013.01); *E04H 15/505* (2013.01); *E04H 15/52* (2013.01); *Y10S 135/912* (2013.01)

(58) Field of Classification Search

CPC ..... E04H 1/1277; E04B 1/34305; E04B 1/34347; E04B 1/34363; E04B 1/34368; E04B 1/34374; Y10S 135/912

USPC .. 52/79.1, 79.5, 79.12, 143, 741.14, 745.02; 109/78, 79

See application file for complete search history.

(56) References Cited

U.S. PATENT DOCUMENTS

| | | | | |
|---|---|---|---|---|
| 3,563,257 | A | 2/1971 | Cummins | |
| 3,875,953 | A | 4/1975 | Couix | |
| 3,923,134 | A * | 12/1975 | Rezazadeh | G07F 5/18 194/241 |
| 4,067,347 | A | 1/1978 | Lipinski | |
| 4,310,195 | A | 1/1982 | Huff | |
| 4,505,078 | A * | 3/1985 | Huh | A47C 29/003 312/242 |
| 4,707,953 | A | 11/1987 | Anderson et al. | |
| 4,844,109 | A | 7/1989 | Navarro | |
| 4,934,396 | A | 6/1990 | Vitta | |
| 5,368,057 | A | 11/1994 | Lubkeman et al. | |
| 5,619,821 | A | 4/1997 | St. George et al. | |
| 5,706,846 | A * | 1/1998 | Sutton | A62B 13/00 135/128 |
| 6,035,875 | A | 3/2000 | Chen | |
| 6,112,757 | A | 9/2000 | Tseng | |
| 6,148,835 | A | 11/2000 | Rhee | |
| 6,390,110 | B1 | 5/2002 | Brown | |
| 6,454,340 | B1 * | 9/2002 | Miller | B60J 7/10 135/136 |
| 7,021,694 | B1 * | 4/2006 | Roberts | B60J 7/102 135/88.13 |
| 7,134,444 | B2 * | 11/2006 | Mintie | B08B 15/00 135/131 |
| 7,406,978 | B2 * | 8/2008 | Mintie | B08B 15/00 135/131 |
| 7,584,763 | B2 | 9/2009 | Yoon | |
| 7,789,099 | B2 | 9/2010 | Mallookis et al. | |
| 8,043,562 | B2 * | 10/2011 | Tomasso | C01N 35/00029 422/72 |
| 8,082,938 | B2 | 12/2011 | Prusmack | |
| 8,429,858 | B1 | 4/2013 | Robinson et al. | |
| 8,622,066 | B2 | 1/2014 | Dolsby et al. | |
| 8,882,135 | B1 | 11/2014 | Chen | |
| 9,534,407 | B2 | 1/2017 | Ballantyne et al. | |
| 2002/0074032 | A1 | 6/2002 | Park et al. | |
| 2002/0184631 | A1 * | 12/2002 | Cezeaux | H04N 5/44543 725/44 |
| 2003/0037812 | A1 | 2/2003 | Stewart et al. | |
| 2003/0074845 | A1 | 4/2003 | Sample et al. | |
| 2004/0020526 | A1 | 2/2004 | Deng | |
| 2004/0050008 | A1 | 3/2004 | Mintie et al. | |
| 2004/0050412 | A1 | 3/2004 | Dotterweich | |
| 2004/0071587 | A1 | 4/2004 | McAtarian | |
| 2004/0074212 | A1 | 4/2004 | Yachi et al. | |
| 2004/0084074 | A1 | 5/2004 | Chiu et al. | |
| 2004/0144412 | A1 | 7/2004 | Tsai | |
| 2004/0144413 | A1 | 7/2004 | Matthews et al. | |
| 2004/0173252 | A1 | 9/2004 | Bouchard | |
| 2004/0261828 | A1 | 12/2004 | Jang | |
| 2005/0011006 | A1 * | 1/2005 | Ellen | A47C 21/08 5/424 |
| 2005/0194032 | A1 | 9/2005 | Zeigler | |
| 2006/0248809 | A1 | 11/2006 | Rulquin et al. | |
| 2007/0051397 | A1 | 3/2007 | Choi | |
| 2008/0006318 | A1 | 1/2008 | Tseng | |
| 2008/0060691 | A1 * | 3/2008 | Harker | E04H 15/36 135/95 |
| 2008/0184631 | A1 | 8/2008 | Schofield | |
| 2008/0257394 | A1 | 10/2008 | Tseng | |
| 2009/0301537 | A1 | 12/2009 | Finck et al. | |
| 2010/0006131 | A1 | 1/2010 | Liu | |
| 2012/0006369 | A1 | 1/2012 | Cantin et al. | |
| 2012/0266544 | A1 * | 10/2012 | Lazarovits | A47B 83/00 52/79.1 |
| 2012/0325279 | A1 | 12/2012 | Munoz | |
| 2014/0235153 | A1 | 8/2014 | Rankin | |
| 2014/0283889 | A1 | 9/2014 | Zhou | |

FOREIGN PATENT DOCUMENTS

| | | | |
|---|---|---|---|
| CN | 202568704 | | 12/2012 |
| WO | 2004011163 | A1 | 2/2004 |
| WO | 200617684 | A2 | 2/2006 |

* cited by examiner

ISOLATION METHOD AND APPARATUS

BACKGROUND OF THE INVENTION

The present invention relates to a method and apparatus for use in isolating a subject, and in one example, to a method and apparatus for isolating a patient within a healthcare facility, such as a hospital ward, or the like.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Infection control in hospitals and other healthcare facilities is becoming increasingly important with the rise in incidences of infectious diseases, drug resistant infections, or the like. Such infections can have severe consequences, particularly in patients with an already compromised immune system, resulting in increased duration of hospital stays, increased treatment costs and increased mortality. Estimates indicate that in some healthcare institutions infection levels can be in the region of 10-20%, meaning infections acquired in medical facilities represent a significant proportion of annual healthcare expenditure.

Infections are typically transmitted through a number of different mechanisms, including contact transmission, droplet transmission and airborne transmission. Current best practice for reducing infection rates typically relies on basic hygiene measures, such as regular hand washing, surface sanitisation, and equipment sterilisation, to thereby prevent infection of other patients. However, the effectiveness of such measures is limited, and World Health Organisation standards indicate that patients with infections or suspected of having infections should be isolated from other patients. This can prove difficult with many facilities not having adequate resources and available space to separate infected patients.

A number of solutions have been proposed to such issues.

EP-0,619,108 describes an enclosure for isolating a patient including an external frame and a flexible envelope suspended from and hanging within the frame. The envelope has a bottom, top, two sides, front and a rear wall portions. One of the side or front wall portions is fitted with a closable entry means allowing entry of the patient. There is an opening in one of the wall portions fitted with an integral filter means adapted to filter out infectious particles from the air and to cooperate with a pump means, and a valve means allowing uni-directional air passage from the outside to the inside of the enclosure. The pump means draws air through said filter means which creates a negative pressure inside the enclosure, whereby air flows in the direction valve-enclosure-filter means ensuring that no contaminating agents will escape from within the enclosure to the outside.

US2004074212 describes a patient isolation unit including a foldable frame body, a flexible envelope made of a flammable resin sheet which can be attached to the assembled frame body, and an exhauster to discharge or exhaust the air from the envelope. The exhauster includes a UV lamp, an HEPA (High-Efficiency Particulate Air) filter, and a blower.

However, these arrangements suffer from a number of drawbacks. For example, the need to maintain a hermetically sealed envelope makes the apparatus complex and hence expensive. The arrangements are also difficult to erect as well as requiring that the arrangement is erected with the patient being subsequently moved into the envelope, which can be inconvenient and which may prevent the arrangements being used in some circumstances. Finally, these arrangements typically require that the doors are opened manually, by hand, meaning infectious materials can be transferred onto the door when this is being opened, leading to subsequent onward transmission, and thereby limiting the effectiveness of the arrangements.

SUMMARY OF THE PRESENT INVENTION

The present invention seeks to ameliorate any one or more of the problems known in the art.

In a first broad form the present invention seeks to provide apparatus for use in isolating a subject, the apparatus including:

a) a frame movable between collapsed and erected configurations;

b) a body supported by the frame, wherein in the erected configuration, the body defines an internal volume for containing a subject to thereby substantially isolate the subject from a surrounding environment; and, c) a door actuator supported by the frame for moving a door between open and closed positions to thereby provide access to the internal volume.

Typically the door actuator includes at least one of:

a) at least one foot pedal coupled to the door; and, b) an electric motor supported by the frame and coupled to at least one of an actuator switch or sensor.

Typically the apparatus includes first and second foot pedals for opening and closing the door respectively.

Typically the door includes at least one curtain moveably mounted to a rail.

Typically the rail is movable between collapsed and operative positions.

Typically the door actuator includes at least one foot pedal operatively connected to the at least one curtain to thereby move the at least one curtain relative to the rail.

Typically the at least one foot pedal is operatively connected to the curtain using a cable and a carriage operatively coupled to the cable.

Typically the carriage is magnetically coupled to the cable.

Typically the rail includes two rail members having first ends hingably coupled to the frame and second ends interconnected via a hinge.

Typically the hinge includes a locking mechanism to lock the rail in an operative position.

Typically the hinge includes first and second body portions and wherein the locking mechanism includes locking bolts for selectively engaging the first and second body portions to thereby lock the hinge.

Typically each rail member encloses an endless belt mounted on sprockets positioned at either end of the rail member, the sprockets at the second end of each rail being mechanically interconnected by an idler gear, and the sprocket at the first end of one of the rail members being connected to an electric motor, thereby allowing the belts to be moved, and wherein in use a curtain is mechanically coupled to each belt so that movement of the belt allows the curtains to be opened or closed.

Typically the frame supports at least one mounting for receiving medical items and wherein when the frame is in the collapsed configuration the apparatus functions as a trolley.

Typically the apparatus includes a panel including the at least one mounting.

In a second broad form the present invention seeks to provide apparatus for use in isolating a subject, the apparatus including:

a) a frame movable between collapsed and erected configurations;

b) a body supported by the frame; and, c) at least one mounting supported by the frame for receiving medical items, and wherein:

i) in the erected configuration, the body defines an internal volume for containing a subject to thereby substantially isolate the subject from a surrounding environment; and, ii) in the collapsed configuration, the apparatus functions as a trolley.

Typically the apparatus includes a panel including the at least one mounting.

Typically the at least one panel is pivotally mounted to the frame, allowing the panel to move between at least engaging and open positions.

Typically the panel engages the frame in the engaging position.

Typically when the frame is in the erected configuration, the panel engages at least part of the frame to thereby assist in bracing the frame.

Typically the medical items include at least one of:

a) instruments;

b) documentation;

c) equipment;

d) protective clothing;

e) cleaning materials; and, f) a waste receptacle.

Typically at least one panel hingably support a shelf, for supporting articles in the storage configuration.

Typically the frame includes:

a) a number of upright legs; and, b) a number of lateral connecting members interconnecting the legs.

Typically the legs are telescopic, allowing the frame to be moved between lowered and raised positions.

Typically the connecting members include scissor arms movable between retracted and extended positions.

Typically the scissor arms are coupled to lower portions of the legs.

Typically the scissor arms on adjacent sides of the frame are independent so that the frame can be extended in a first direction and then subsequently in a second direction orthogonal to the first direction.

Typically apparatus includes at least one panel that engages at least one of the scissor arms when the frame is in the erected configuration to thereby assist in bracing the frame.

Typically the frame includes wheels for movably supporting the frame on a surface.

Typically the wheels are selectively lockable to assist with movement of the frame between the collapsed and erected positions.

Typically the body includes a roof member and a number of wall members extending between a supporting surface and the roof member.

Typically the body includes at least two wall members.

Typically the roof and wall members comprise flexible water resistant sheet material.

Typically the body is removably mounted to the frame.

Typically the body is mounted inwardly of the frame in use.

Typically the walls engage a surface supporting the apparatus using at least one of:

a) a weighted portion provided in the region of a lower edge of the walls; and, b) an at least partially adhesive material provided on a lower edge of the walls; and, c) a beam coupled to a lower edge of the walls.

Typically the adhesive material includes an adhesive strip mounted to a lower edge of the walls.

In a third broad form the present invention seeks to provide apparatus for use in isolating a subject, the apparatus including:

a) a frame; and, b) a body supported by the frame, wherein the body defines an internal volume for containing a subject to thereby substantially isolate the subject from a surrounding environment and wherein a lower edge of the body is adapted to engage a surface on which the apparatus is arranged, to thereby assist in preventing contaminants passing between the body and the surface.

Typically the body includes a roof member and a number of wall members extending between a supporting surface and the roof member.

Typically the walls engage a surface supporting the apparatus using at least one of:

a) a weighted portion provided in the region of a lower edge of the walls; and, b) an at least partially adhesive material provided on a lower edge of the walls; and, c) a mechanical beam coupled to a lower edge of the walls.

In a fourth broad form the present invention seeks to provide apparatus for use in isolating a subject, the apparatus including:

a) a frame movable between collapsed and erected configurations, the frame including:

i) a number of upright legs; and, ii) a number of lateral connecting members interconnecting the legs, the connecting members include scissor arms movable between retracted and extended positions and wherein scissor arms on adjacent sides of the frame are independent so that the frame can be extended in a first direction and then subsequently in a second direction orthogonal to the first direction; and, b) a body supported by the frame, wherein in the erected configuration, the body defines an internal volume for containing a subject to thereby substantially isolate the subject from a surrounding environment.

Typically the body is disposable.

Typically the apparatus includes roof supports provided in a roof of the body, the roof supports being coupled to the frame in use thereby supporting the roof.

Typically the roof supports are pivotally biased to thereby tension, raise and support the roof in use.

In a fifth broad form the present invention seeks to provide a curtain rail apparatus including legs supporting to a hingeable curtain rail, the rail including two rail members having first ends hingably coupled to the legs and second ends interconnected via a hinge.

Typically the door actuator includes at least one of:

a) at least one foot pedal coupled to the door; and, b) an electric motor supported by the frame and coupled to at least one of an actuator switch or sensor.

Typically the apparatus includes first and second foot pedals for opening and closing the door respectively.

Typically the door includes at least one curtain moveably mounted to a rail.

Typically the rail is movable between collapsed and operative positions.

Typically the door actuator includes at least one foot pedal operatively connected to the at least one curtain to thereby move the at least one curtain relative to the rail.

Typically the actuator is operatively connected to the curtain using a cable and a carriage operatively coupled to the cable.

Typically the carriage is magnetically coupled to the cable.

Typically the rail includes two rail members having first ends hingably coupled to the frame and second ends interconnected via a hinge.

Typically the hinge includes a locking mechanism to lock the rail in an operative position.

Typically the hinge includes first and second body portions and wherein the locking mechanism includes locking bolts for selectively engaging the first and second body portions to thereby lock the hinge.

Typically each rail member encloses an endless belt mounted on sprockets positioned at either end of the rail member, the sprockets at the second end of each rail being mechanically interconnected by an idler gear, and the sprocket at the first end of one of the rail members being connected to an electric motor, thereby allowing the belts to be moved, and wherein in use a curtain is mechanically coupled to each belt so that movement of the belt allows the curtains to be opened or closed.

In a sixth broad form the present invention seeks to provide a method of erecting apparatus for use in isolating a subject, the method including:

a) providing the apparatus adjacent a bed;

b) extending a collapsible frame in a first direction perpendicular to a length of the bed; and, c) extending the collapsible frame in the second direction so that a body supported by the frame defines an internal volume for containing a subject to thereby substantially isolate the subject from a surrounding environment.

Typically the method includes lowering the bed prior to moving the frame over the bed.

Typically the method includes selectively locking wheels of the frame to hold the frame in position during frame extension.

Typically the method includes attaching the body to the frame.

Typically the frame includes a locking mechanism, and wherein the method includes releasing the locking mechanism.

Typically when the frame is in a collapsed position, at least one panel engages the frame and wherein the method includes opening the panel by swinging the panel outward to allow the frame to be extended.

Typically the method includes moving the frame into a raised position using telescopic legs.

Typically the method includes attaching at least one curtain to a rail.

Typically the method includes using a door actuator to open and close the at least one curtain to thereby engage a coupling between a carriage system supporting the at least one curtain and a belt or cable of the door actuator.

Typically the method includes attaching walls of the body to a floor using an adhesive.

Typically the method includes attaching walls of the body to a floor using a double sided adhesive tape.

Typically the method includes attaching the walls of the body to a mechanical beam that provides pressure to the floor.

Typically the method includes accessing at least one connection to equipment via at least one opening in a wall, or roof of the body, the at least one opening being created using perforations in the wall or roof of the body.

Typically the method includes taping edges of the at least one opening to a surface against which the opening abuts.

Typically the method includes disposing of the body after use.

BRIEF DESCRIPTION OF THE DRAWINGS

An example of the present invention will now be described with reference to the accompanying drawings, in which: —

DETAILED DESCRIPTION OF THE PREFERRED EMBODIMENTS

Figure 1A:
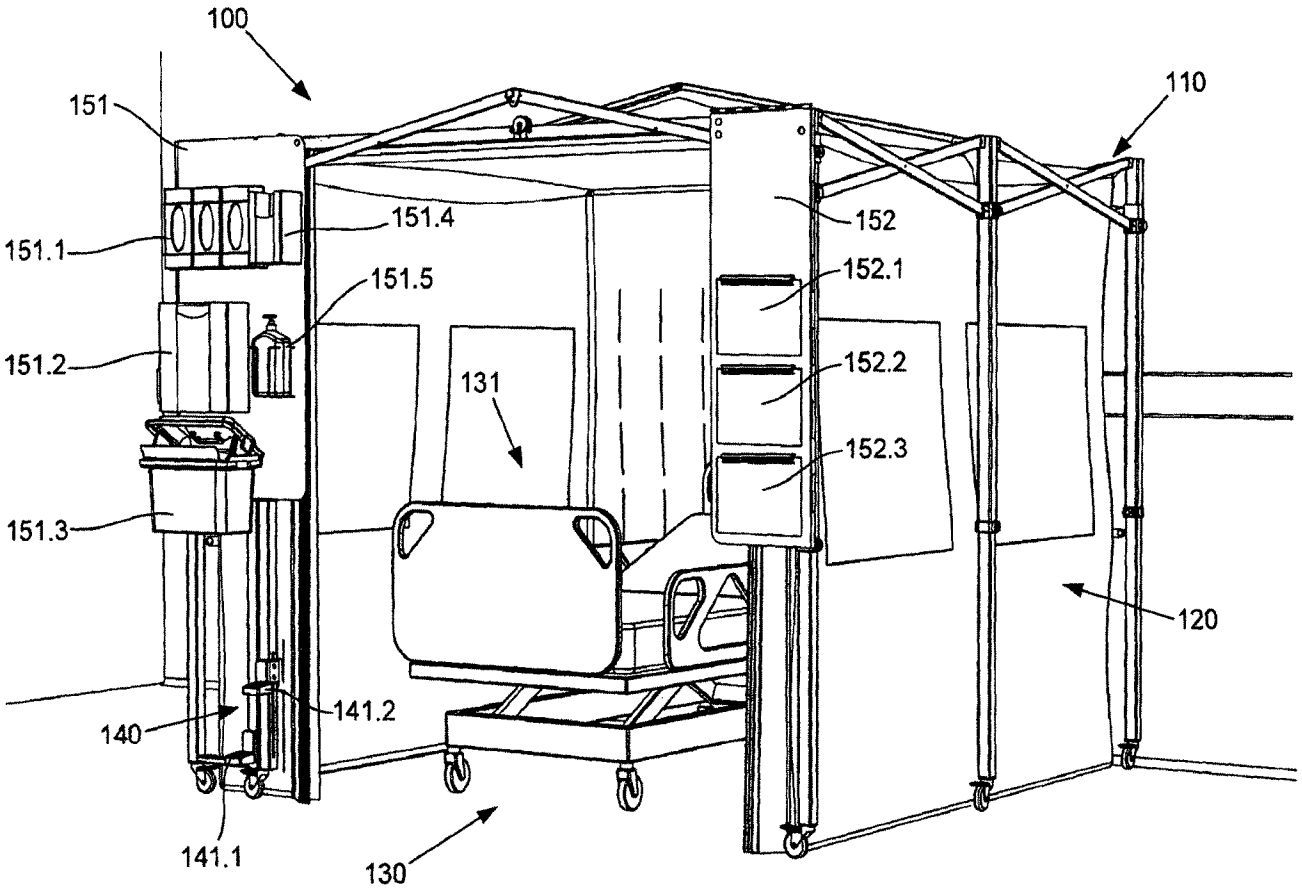
FIG. 1A is a schematic perspective view of an example of apparatus for use in isolating a subject.

An example of an apparatus for use in isolating a subject, such as a patient, will now be described with reference to FIGS. 1A to 1D.

In this example, the apparatus 100 includes a frame 110, which in use is movable between collapsed and erected configurations. A body 120 is supported by the frame 110, so that when the frame 110 is in the erected configuration, the body 120 defines an internal volume 130 for containing a subject, such as a patient on a bed 131, to thereby substantially isolate the subject from a surrounding environment, such as a hospital ward or similar.

Figure 1B:
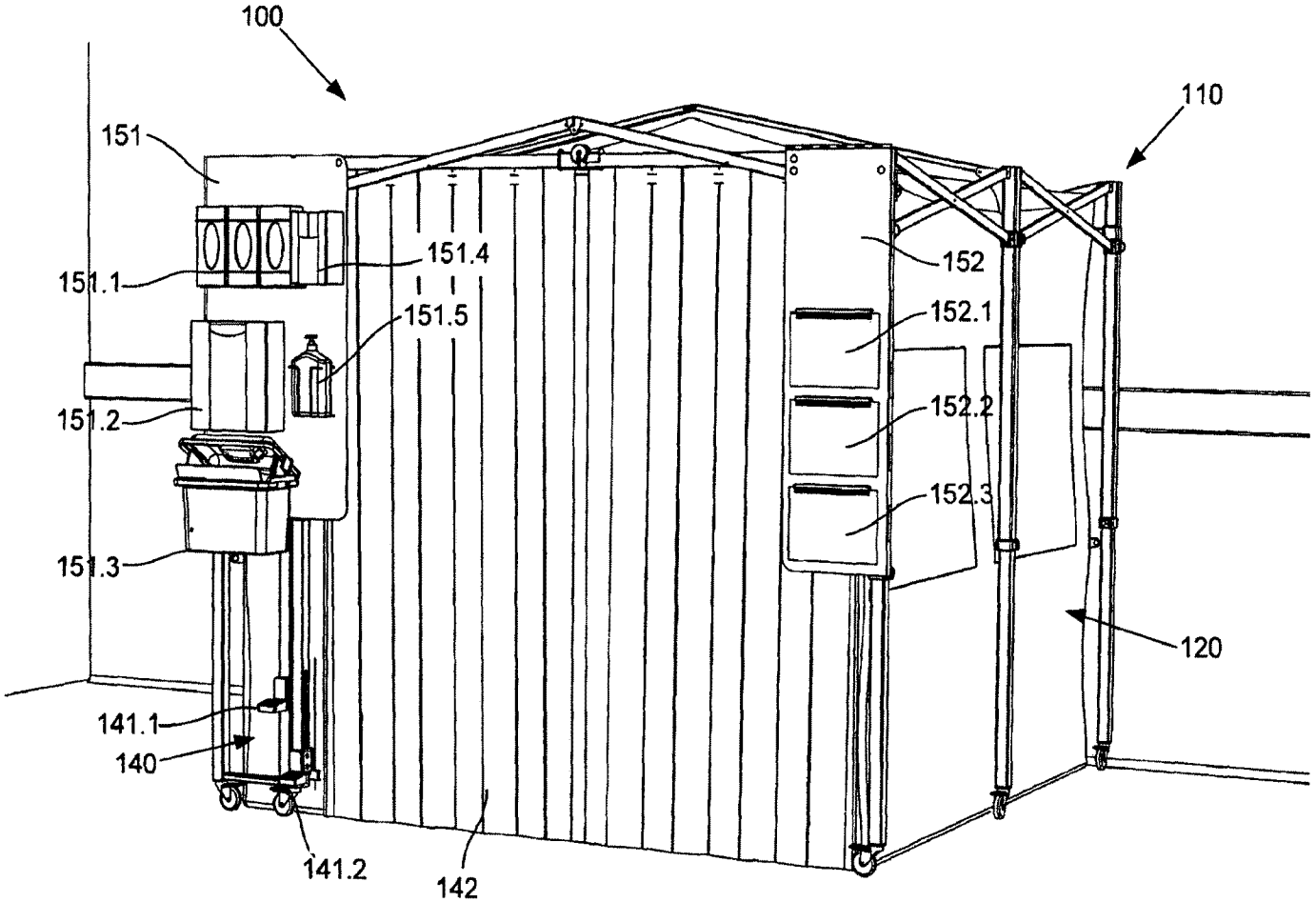
FIG. 1B is a schematic perspective view of the apparatus of FIG. 1A with a door in a closed position.

The apparatus 100 also typically includes a door actuator 140 supported by, and in particular mounted either to, or within, the frame 110. The door actuator 140 is for moving a door 142 between open and closed positions, as shown in FIGS. 1A and 1B, respectively. In the closed position, the door closes the internal volume, whilst in the open position the door provides access to the internal volume, thereby allowing users, such as medical practitioners to access the subject when required, while isolating the subject at other times.

Accordingly, the above described arrangement provides apparatus for isolating a subject within an environment, such as a medical facility, hospital ward, or the like.

Figure 1C:
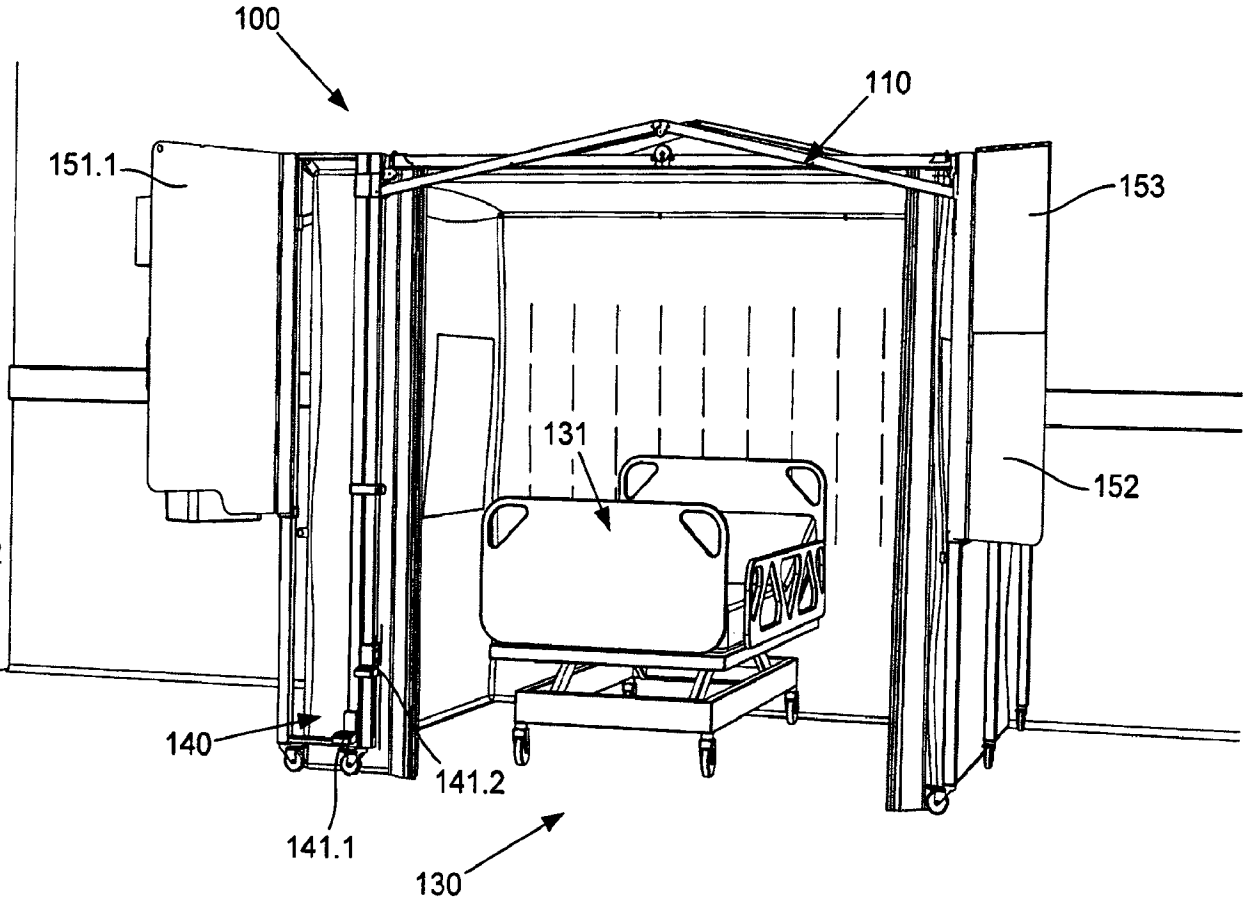
FIG. 1C is a schematic perspective view of the apparatus of FIG. 1A with a door and panels in open positions.

The use of a collapsible frame 110 allows the apparatus 100 to be provided in an operative configuration, shown in FIGS. 1A to 1C, with the frame 110 erected and body 120 attached, when it is required to isolate a subject. However, the apparatus 100 can also be provided in a storage configuration shown in FIG. 1D, in which the frame 110 is collapsed, when isolation of a subject is not required. This allows the apparatus to be conveniently stored and rapidly erected when required.

The use of a suitable body 120 can allow sufficient a degree of isolation to be provided to significantly reduce infection rates. For example, whilst the apparatus could be hermetically sealed, this is not essential, and more typically the apparatus is designed merely to help provide a barrier to contamination by at least one of solid, contact, fluid and droplet-borne contaminants. As part of this, a lower edge of the body may be adapted to engage a surface, such as a floor, on which the apparatus is arranged, thereby preventing contaminants passing between the body and the floor. This could be achieved using a variety of techniques, such as through the use of an adhesive arrangement, as will be described in more detail below, although alternatively a weighted arrangement or similar could be used.

Additionally, the apparatus acts as a warning to individuals that the isolated subject is infectious or suspected of being infectious, thereby serving to remind individuals regarding hygiene requirements, such as hand washing and the like, which further helps protect against contact transmission. Thus, even without hermetic sealing, the apparatus 100 operates to significantly reduce the opportunity for infection, for example through contact or droplet transmission.

The above arrangement allows the body to be formed of a suitable flexible sheet material, such as a water resistant fabric, plastic sheeting, or the like, meaning the body can be lightweight and cheaply manufactured, and allowing the body to be disposed of following use. The use of a disposable body can further help reduce incidences of infection.

Furthermore, use of a suitable door and door actuator can allow ingress and egress without a user being required to touch the door, which can further assist in reducing spreading of infectious materials. For example, the door can include one or more curtains 142 moveably mounted to a rail, with the actuator 140 including at least one, and more typically two foot pedals 141.1, 141.2, coupled to the curtains 142 via a cable or the like. This can provide a foot pedal system allowing hands free operation of the curtain door, enabling users to open and close the door without having to touch the door. In one example, the foot pedals project inwardly and outwardly from the frame, allowing the door to be actuated both from within and outside of the internal volume.

However, it will be appreciated that other actuator arrangements could be used. In one particular example, this is achieved using an electric motor supported by the frame and coupled to at least one of an actuator switch or sensor. However, electric/electronic, pneumatic, hydraulic, chain, belt, or other similar arrangements, with the actuator being controlled using foot pedals, or other suitable arrangements, such as buttons or electronic sensors, such as proximity or motion sensors, voice control, or the like, can be used. In one further example, sensors may be adapted to detect an identity of individuals attempting to open the door, for example by using an RFID (Radio Frequency Identity) sensor and an associated tag worn by the individual. This can then be used to record an identity of individuals accessing the apparatus 100, which can be used for example in infection tracking, or to only allow access to authorised personnel, as will be appreciated by persons skilled in the art.

A number of further features will now be described.

In one example, the frame 110 supports at least one mounting for receiving medical items. The mounting could be of any appropriate form, and could include for example mountings coupled to the frame 110, such as a rack, a wire mesh, a beam from which items are suspended, or the like. Typically however, the apparatus includes at least one, and more typically two panels 151, 152, which include one or more mountings incorporated therein.

In this example, a first panel 151 includes at least one mounting for receiving medical items, shown generally at 151.1, 151.2, 151.3, 151.4, 151.5. Thus, the apparatus 100 can be used to support instruments, documentation, equipment, protective clothing, disposal bags, cleaning materials, hand sanitisation fluid, a waste receptacle, or the like.

Additionally, a second panel 152 can act as a notice board, allowing information regarding the patient to be displayed. In one example, the notice board can be made of material that can be written on using a non permanent marker, or the like, allowing patient details, such as name, identifier or the like to be easily displayed. The notice panel 152 may also include at least one mounting 152.1, such as clips, pockets, or the like, for receiving items such as documents, x-rays, patient notes, or similar. The notice panel can also act to display warning signs or notifications, for example to advise individuals, such as medical personnel, visitors, or the like of the infection suffered or suspected to be suffered by the patient, and/or any precautions that need to be taken as a consequence. Thus, for example, the sign could indicate that clearance should be sought from medical personnel before entering, or the like. It will be appreciated that this can allow medical personnel access to patient information, without having to enter the internal volume 130, thereby reduce the likelihood of transmission of any infections.

The second panel 152 also acts to hingably support a shelf 153, which in the storage configuration rests on top of the collapsed frame and can act to support articles, whilst in the operative configuration the shelf is stored in a back to back arrangement with the second panel 152.

When the apparatus 100 is in the operative configuration, the panels 151, 152 are arranged on either side of the door, thereby providing users easy access to stored items and information on the notice board. This allows items to be conveniently stored outside the internal volume to prevent unwanted contamination of the items, whilst ensuring the items are readily available if required. Furthermore, by providing one or more waste receptacles, this can allow materials removed from the internal volume to be immediately disposed of, thereby further reduce the risk of spreading infection. In one example, one waste receptacle can be for sharps only, as this allows a relatively small receptacle to be used. Additionally or alternatively however, a receptacle could be adapted to receive gowns, gloves, instruments, or the like, and it will be appreciated that this will depend on the preferred configuration.

Figure 1D:
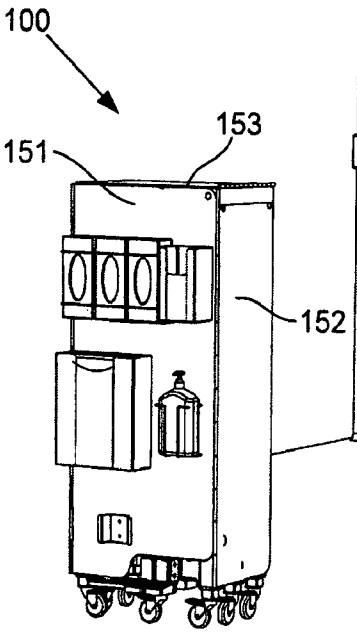
FIG. 1D is a schematic perspective view of the apparatus of FIG. 1A in a storage configuration.

Furthermore, when the frame 110 is in the collapsed configuration shown in FIG. 1D, the panels can be provided on an outside of the frame 110, thereby allowing items to be retained mounted on the panels. This allows the apparatus to function as a trolley, allowing items and the apparatus 100 to be stored thereon, and moved around a medical facility as required.

Accordingly, in one example, the apparatus 100 can function either to isolate a subject, or as an infection control, PPE (Personal Protective Equipment) trolley, equipment trolley, or other suitable trolley. By providing a dual use configuration, this allows the apparatus to be provided on a ward, functioning as a trolley so that the apparatus does not take up unnecessary storage room. In the event that a patient is discovered to be infectious or is suspected of being infectious, the apparatus can be quickly erected around the patient, as Will be described in more detail below. Thus, it will be appreciated from this, that the apparatus can be retained on a ward as an accessible equipment trolley whilst not being used, or used to isolate a patient whilst in the operative configuration. Even in the operative configuration, equipment and other items provided on the equipment trolley are still accessible, meaning the storage functionality provided by the apparatus is not impacted even while the apparatus is in the operative configuration.

In one example, the panels 151, 152 and/or shelf 153 can be pivotally mounted to the frame 110, allowing the panels 151, 152 and/or shelf 153 to move between engaging positions, in which the panels engage the frame 110, and open positions. This can be used to assist in moving the frame 110 between the erected and collapsed configurations, as well as allowing greater access to the internal volume by increasing the door width, as shown in FIG. 1C, which can be useful in emergency situations.

Engagement of the frame by the panels 151, 152 and/or shelf 153 can also act to lock the frame 110 in either the collapsed or erected configurations, as well as acting to assist in bracing the frame 110, thereby acting to strengthen the frame 110, when the panels are in engaged positions, as will be described in more detail below. The panels can be engaged to the frame using any suitable technique, such as a magnetic coupling, latch, or the like. It will be appreciated that similar functionality could be provided using other techniques, so for example, locking of the frame could be achieved using any latching mechanism.

An example of the frame 110 will now be described in more detail with reference to FIGS. 2A to 2F.

In this example, the frame 110 includes a number of upright legs 201, 202, 203, 204, 205, 206, 207 interconnected by a number of lateral connecting members 221, 222, 223, 224, 226. In this example, seven legs are shown, but it will be appreciated that this is not essential, and four or more may be used. A collapsible curtain rail 225 may also extend across a front of the frame 110 to support the curtains 142, in use.

Whilst any configuration of frame 110 can be used, in the current example, two sets of three legs 201, 202, 203; 204, 205, 206, are arranged along respective sides of the frame 110, the legs in each set being interconnected by connecting members 221, 224 and the sets being interconnected by connecting members 222, 223, 226 so that the frame 110 has a substantially cuboid configuration in the erected configuration. The leg 207 is coupled to the leg 206, via connecting beams 208 extending laterally between the legs 206, 207. The leg 207 is positioned between the legs 203, 206, extending partially across a front of the frame to thereby provide additional support for the door 142, as well as to support the door actuator 140 and associated pedals 141.1, 141.2.

Figure 2A:
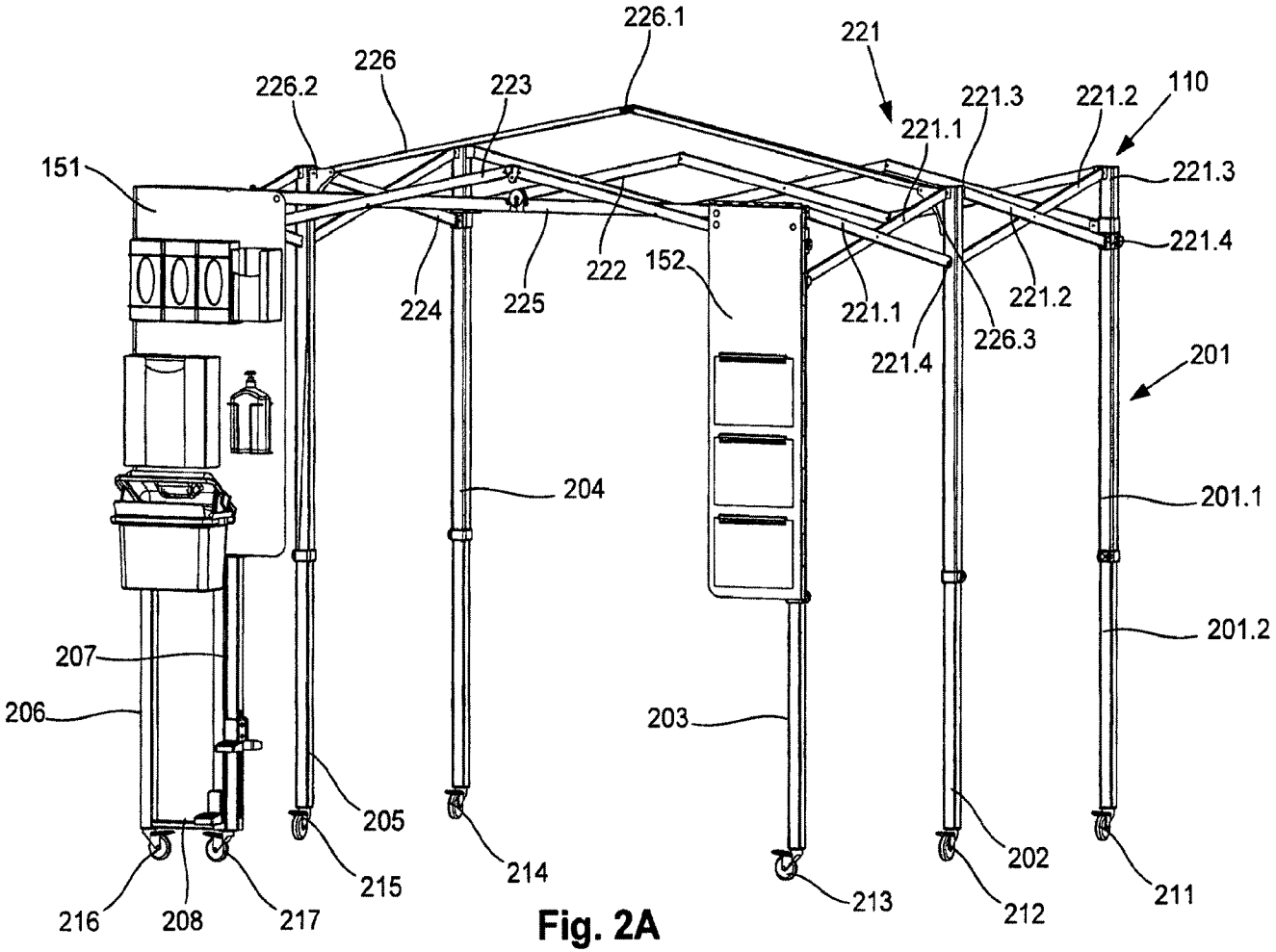
FIG. 2A is a schematic perspective view of an example of the frame of the apparatus of FIG. 1A in an erected configuration.
Figures 2B, 2C, 2D:
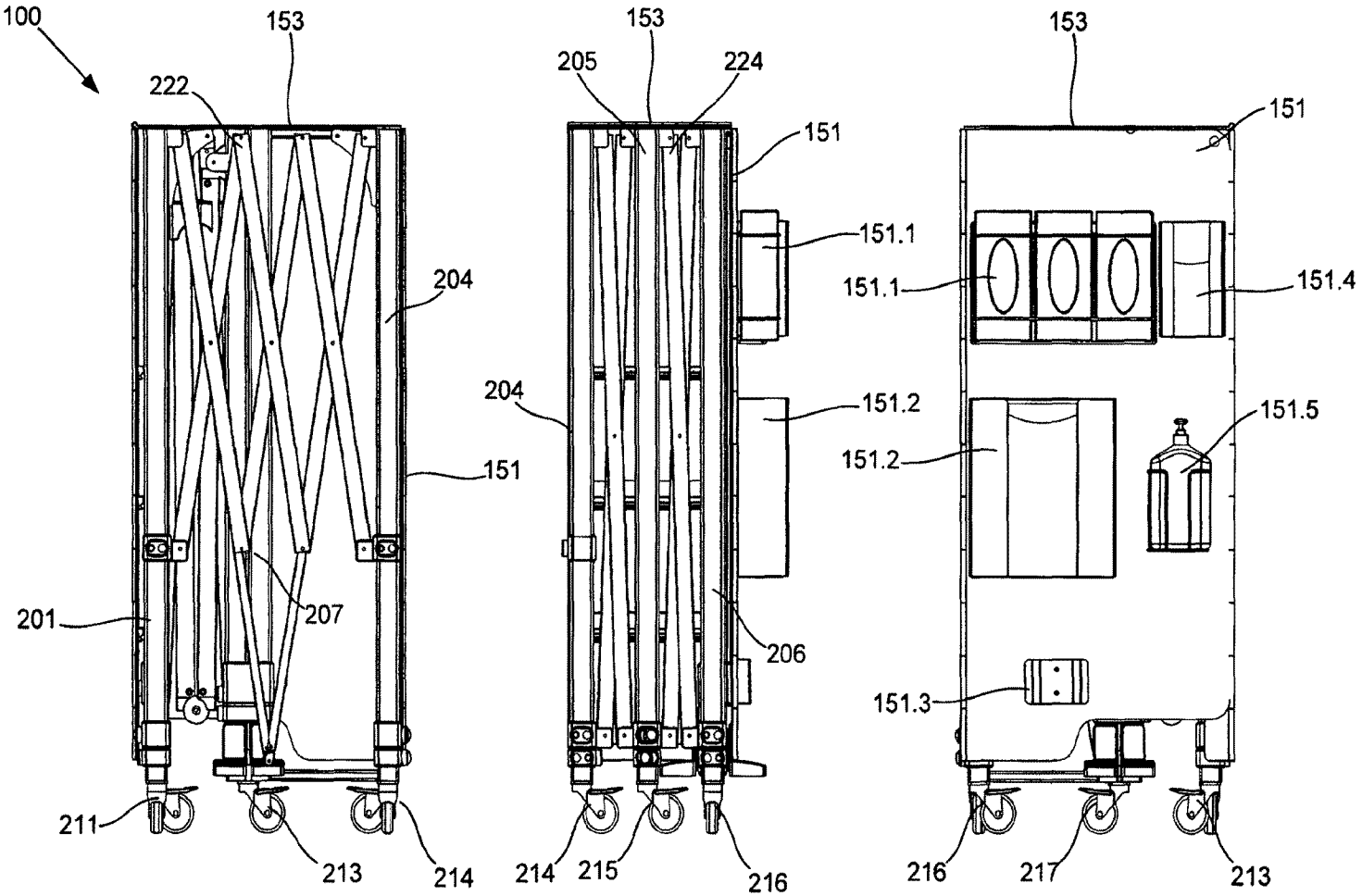
FIG. 2B is a schematic rear view of the frame of FIG. 2A in a collapsed configuration.
FIG. 2C is a schematic right side view of the frame of FIG. 2A in the collapsed configuration.
FIG. 2D is a schematic front view of the frame of FIG. 2A in the collapsed configuration.
Figure 2F:
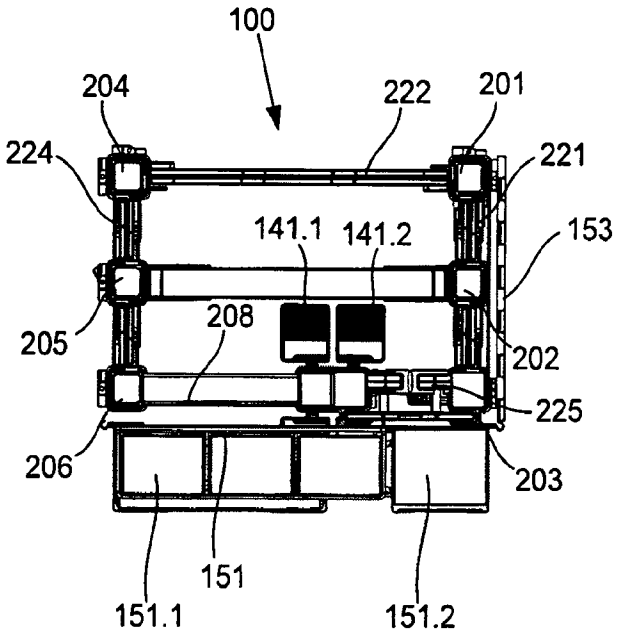
FIG. 2F is a schematic plan view of the frame of FIG. 2A in the collapsed configuration.
Figure 2E:
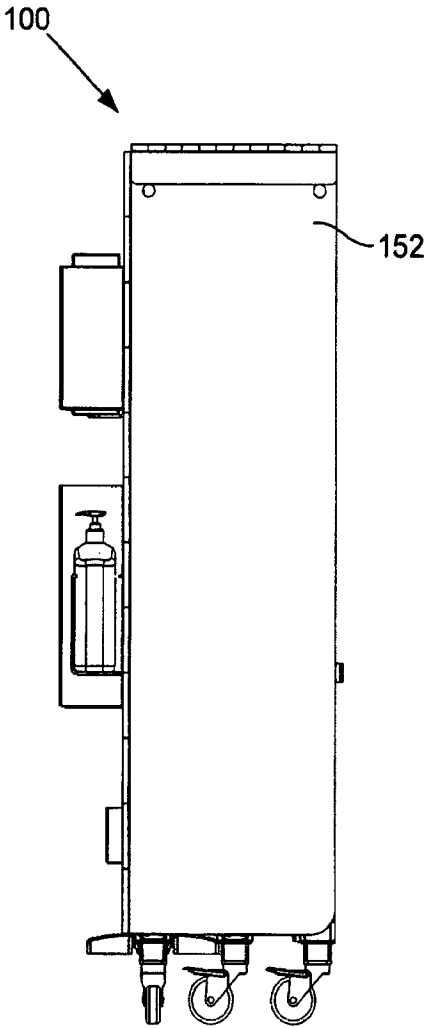
FIG. 2E is a schematic left side view of the frame of FIG. 2A in the collapsed configuration.
Figure 3A:
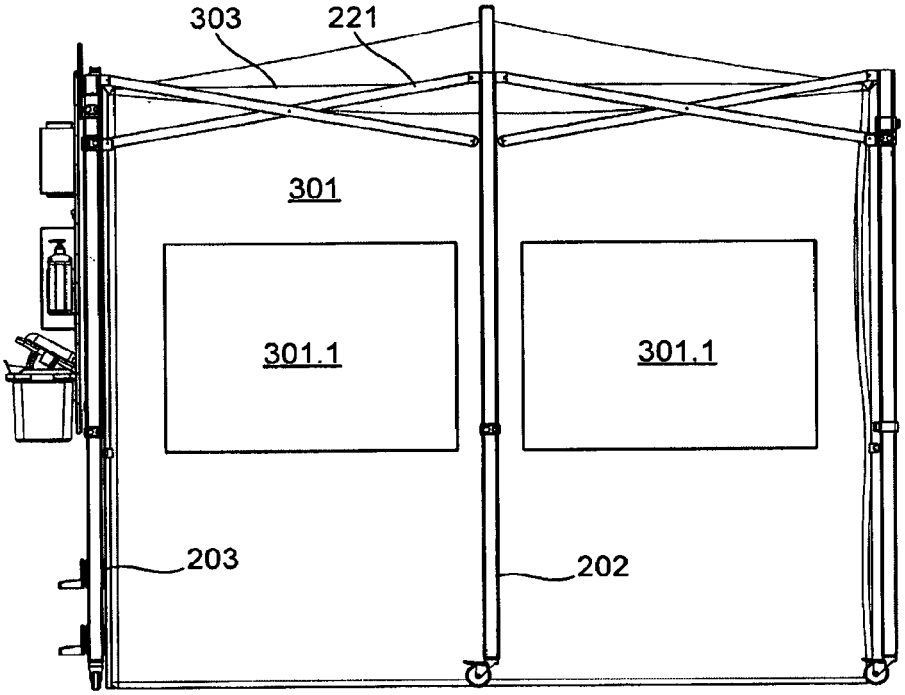
FIG. 3A is a schematic side view of the apparatus of FIG. 1A.
Figure 3B:
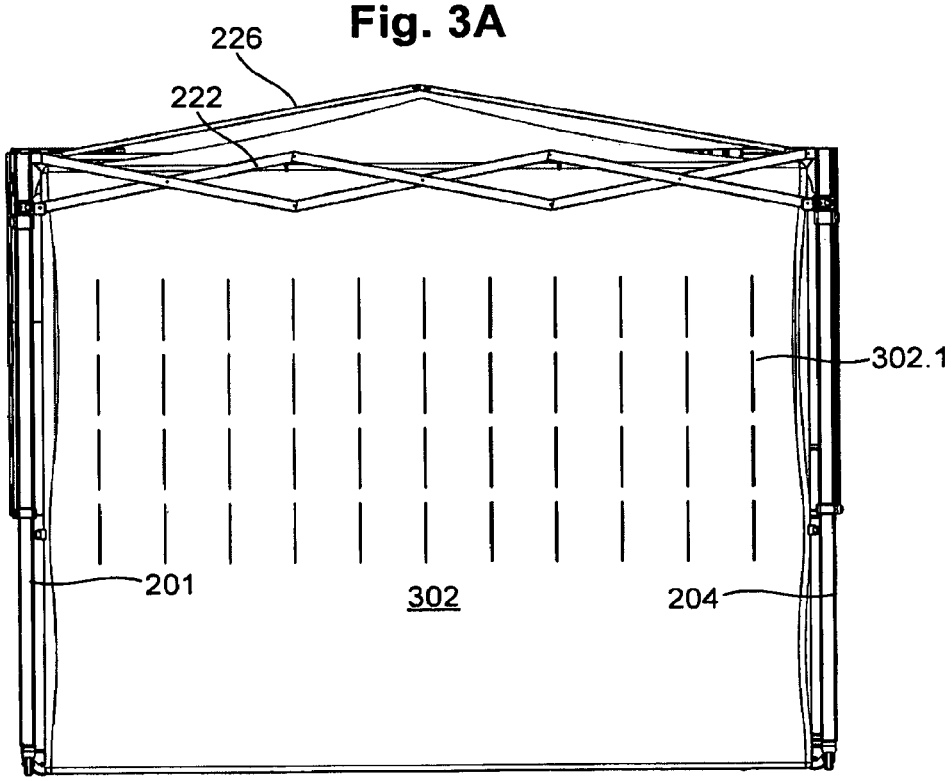
FIG. 3B is a schematic rear view of the apparatus of FIG. 1A.
Figure 3C:
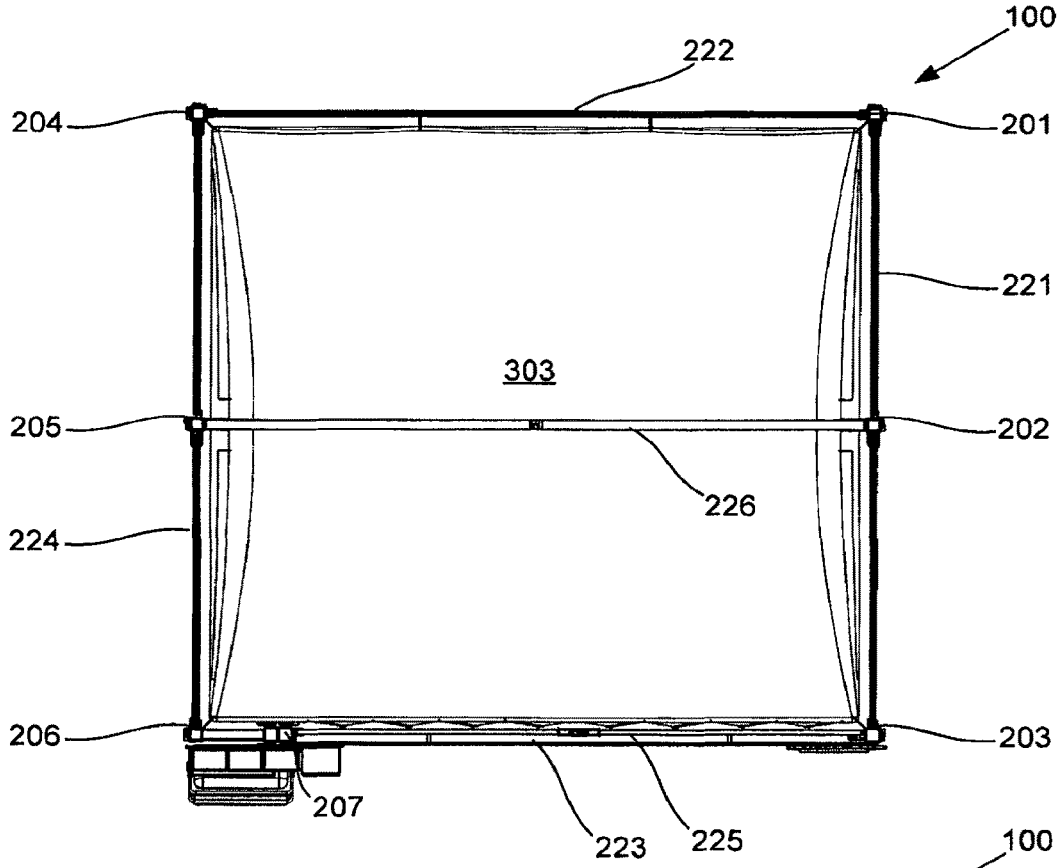
FIG. 3C is a schematic plan view of the apparatus of FIG. 1A.
Figure 3D:
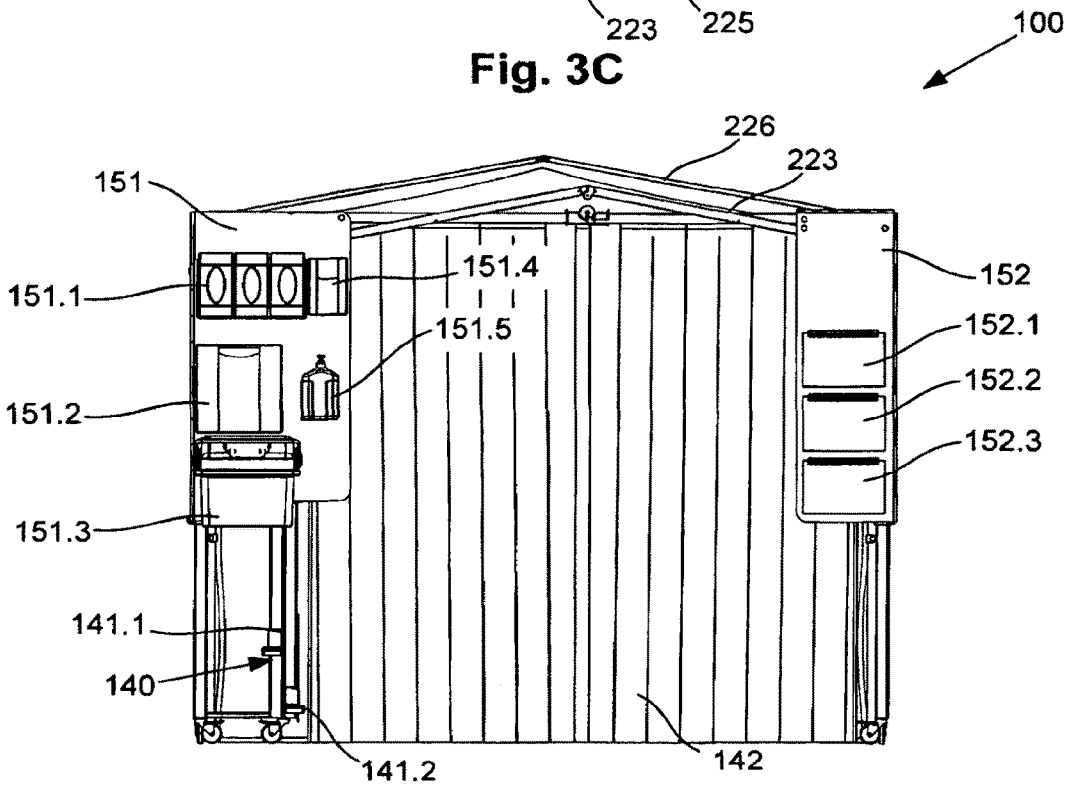
FIG. 3D is a schematic front view of the apparatus of FIG. 1A.

As shown for the leg 201, the legs 201, 202, 203, 204, 205, 206, 207 may be made of multiple sections 201.1, 201.2, and are telescopic, allowing the frame 110 to be moved between a raised position, shown for example in FIG. 2A, and lowered position, shown for example in FIGS. 2B to 2F.

The legs 201, 202, 203, 204, 205, 206, 207 can include a biased telescopic system, for example using gas struts, spring mechanisms, linear actuators, lead screws, a counterweight, or the like, to thereby at least partially support the weight of the frame 110 and body 120, thereby making the frame 110 easier to raise. For example the legs could be biased into the raised position so a user need simply unlock the legs, allowing the frame 110 to automatically raise, although other arrangements could be used. The legs 201, 202, 203, 204, 205, 206, 207 can also be locked into either the raised or lowered position, preventing inadvertent raising or lowering of the frame 110.

The connecting members 221, 222, 223, 224 may be of any suitable form. For example, the connecting member 221 includes pairs of pivotally connected scissor arms 221.1, 221.2 attached to the legs 201, 202, 203, via fixed and movable brackets 221.3, 221.4. This allows the scissor arms to move between an extended position, shown for example in FIG. 2A, and retracted positions, shown for example in FIGS. 2B to 2F. It will be appreciated that the connecting members 222, 223, 224 typically have a similar configuration, and that these will not therefore be described in any further detail. It should also be noted that in one example, the connecting member 223 may incorporate the rail 225, so that the rail forms at least part of the arms of the scissor mechanism. The connecting member 226 is typically hingably mounted to the frame via hinges 226.2, 226.3 and further includes a single hinged joint 226.1, which can be over extended so that the connecting member 226 extends above a level of the remainder of the frame 110. This allows be used for supporting the body 120, as will be described in more detail below. The hinges 226.2, 226.3 can be used to provide additional support to the legs 202, 205, thereby preventing unwanted movement of the legs.

It will be noted that in one example, the scissor arms of the connecting members 221, 222, 223, 224 on adjacent sides of the frame are independent, meaning the frame can be expanded in first and second orthogonal directions independently. For example, the frame can be extended widthwise and then subsequently extended lengthwise, as will be described in more detail below.

In one example, the panels 151, 152, which are pivotally attached to the legs 216, 213, respectively, are adapted to engage the connecting member 223. This acts to assist in bracing the legs 216, 213 relative to the connecting member 223, thereby enhancing the strength of the frame 110 in the erected configuration.

The frame 110 typically includes wheels 211, 212, 213, 214, 215, 216, 217, which in this example are mounted on respective legs 201, 202, 203, 204, 205, 206, 207. The wheels 211, 212, 213, 214, 215, 216, 217 can be of any suitable form such as castor wheels, or the like, allowing the frame 110 to be movably supported on a surface, such as the floor, so that the apparatus 110 can be easily moved. The wheels 211, 212, 213, 214, 215, 216, 217 may also be selectively lockable to assist with movement of the frame between the collapsed and erected configurations, as will be described in more detail below.

It will be appreciated that the frame 110 is typically made of lightweight, durable and robust materials, that may be cleaned using suitable cleaning products. For example, the legs and connecting members may be made of lightweight metals such as aluminium, high density polymeric materials, such as HDPE (High Density Polyethylene), Carbon Fibre, fibre glass, or the like.

As shown in FIGS. 3A to 3D, the body 120 typically includes a roof member 303 and a number of walls 301, 302 extending between a supporting surface and the roof member 303 when the apparatus 100 is in the operative configuration.

The body 120 and the curtains 142 are typically made of a flexible, lightweight, substantially water-resistant sheet material, such as a fabric, PVC (Polyvinyl Chloride), PE (Polyethylene) or the like, thereby providing a barrier to contaminants within the internal volume. In one preferred example the material is a spunbond Polypropylene non-woven fabric laminated to a PE film, as used for example in disposable medical gowns, but other materials could be used. In any event, it will be appreciated that the body 120 is similar in form to a tent body, although this is not essential. The body 120 is typically removably mounted to the frame 110, allowing the body 120 to be disposed of and replaced following use. The body 120 is also usually mounted inwardly of the frame 110 to thereby prevent the frame being exposed to contaminants, with the body 120 being coupled to the frame using any appropriate technique, such as straps, clips or the like.

In use, the walls 301, 302 can be adapted to engage the floor, thereby reducing the chance of contaminants passing under the walls. This can be achieved in any suitable manner such as through the use of a weighted portion proximal of a lower edge of the walls, such as a weighted hem, or a beam forming part of the frame 110 that fixes to the lower edge of the walls and urges the walls against the floor, or the like. More typically however, an at least partially adhesive material can be provided on a lower edge of the walls, to thereby adhere the walls to the floor. In one example, this is achieved using double sided adhesive tape, or adhesive tape attached to the walls with the adhesive side facing away from the wall, although other arrangements could be used.

Additionally, perforations 302.1 or slots or other access points can be made or provided in the body 120 to provide access to external utilities, such as oxygen, suction, power and the like, as will be described in more detail below. Such perforations or openings can be provided in the rear walls 302, as in use, this typically abuts a wall of the medical facility containing connections to external utilities, as will be described in more detail below. However, similar perforations or slots may also be provided in the roof or other parts of the body, to allow access for example to light fittings, or other equipment. Additionally, the body may include openings or semi-porous portions, such as panels, to allow for air circulation. These are typically provided in the ceiling to minimise transmission of droplets and projectile fluids, although this is not essential, and suitable arrangement of vents could be used.

The side walls 301 may also include window portions 301.1, typically formed from an optically transparent material. This allows individuals to view the subject without having to enter the internal volume, whilst providing the subject with a view of the surrounding ward or other environment, which is important in ensuring the subject does not feel too isolated. It will also be appreciated that window curtains (not shown) can be provided allowing the windows to be covered, thereby providing privacy to the subject as required.

The body 120 typically includes at least two wall members. In the current example, three wall members are shown including two side walls 301 (a right-hand side wall 301 only is shown for the purpose of illustration but the left hand-side wall would have a similar configuration) and a rear wall 302. A short front wall member (not shown) may also extend between the legs 206, 207, with a remaining front of the body being provided by the curtains 142. However, it will be appreciated that other arrangements could be used. For example, the rear wall 302 could be omitted with the side walls being attached to a wall of the ward using adhesive tape or the like.

The curtains 142 can be manufactured using similar materials to the body 120. The curtains 142 could further include magnetic portions, such as a magnetic strip along curtain edges, allowing the curtains to be coupled to the frame 110 and/or walls 301, and/or to allow two curtains 142 to be interconnected. Alternatively, the curtains 142 can be formed integral with the walls, or welded to the walls, for example using heat welding, as will be appreciated by persons skilled in the art.

Figure 4:
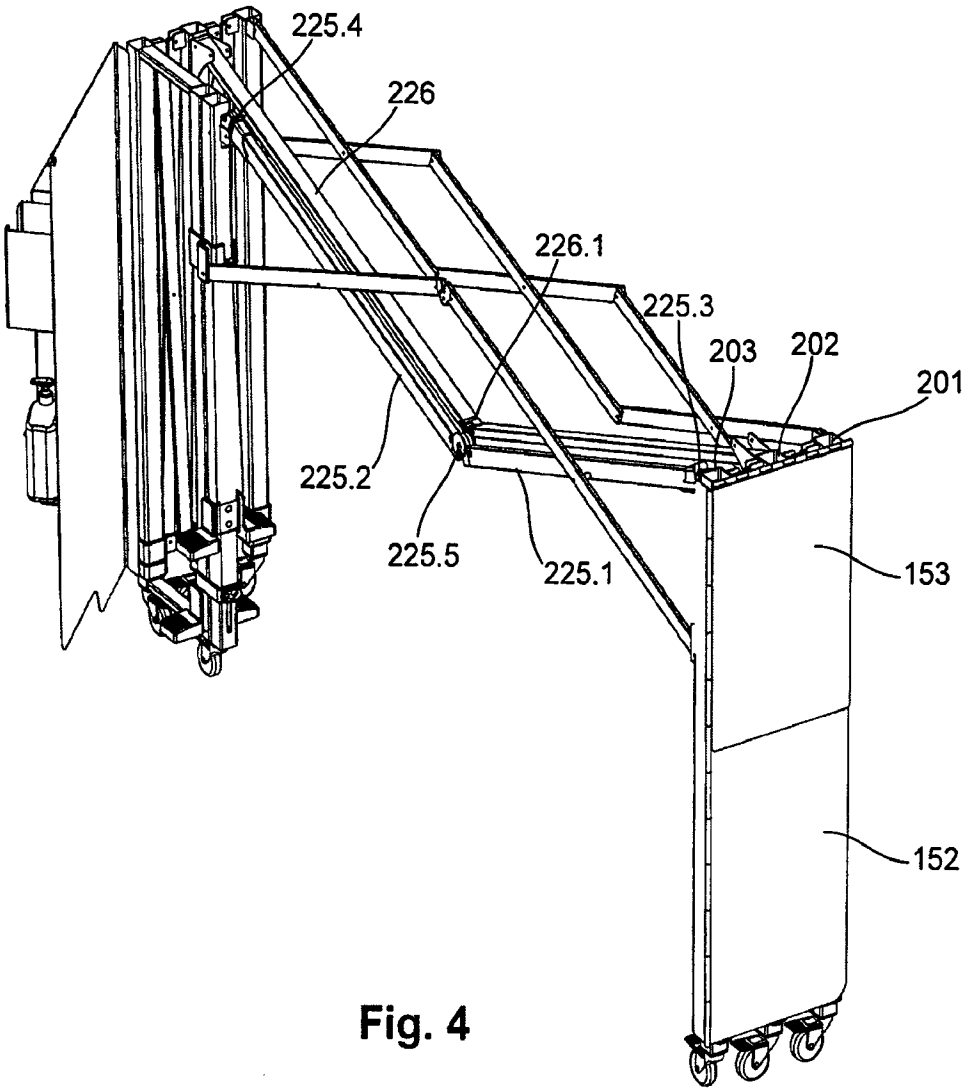
FIG. 4 is a schematic perspective view of the apparatus of FIG. 1A showing a curtain rail.

An example of the rail 225 will now be described with reference to FIG. 4.

In this example, the rail 225 includes two rail members 225.1, 225.2, having first ends hingably coupled to the frame 110, for example to the legs 203, 207, and second ends hingably interconnected via respective hinges 225.3, 225.4, 225.5. This allows the rail 225 to fold as the frame 110 is collapsed or opened. The hinges can incorporate a locking mechanism to lock the rail in an operative position, thereby assisting to support the weight of the curtains 142.

The rail incorporates a cable opening/closing mechanism, with the cable extending through or around the hinges 225.4, 225.5 and being attached to the foot pedals 141.1, 141.2, allowing these to open and close the door, respectively. The cable can be coupled to a carriage system mounted externally on the rail that supports the curtains. The carriage system can be coupled to the cable via a mechanical fixing extending through a slot in the rail. However, alternatively the carriage system can be coupled to the cable via magnets, so that a magnetic force, operatively connects the carriage system to the cable. This allows the carriage system to be operatively disconnected from the cable, so that the curtains can be opened manually. This allows the door to be opened rapidly, for example, during an emergency, as well as avoiding the need to include a slot in the rail, which can harbour contaminants or the like. It will be appreciated from the above that the term cable is not intended to be limiting and could cover any elongate flexible member, such as a chord, wire, belt, or the like.

In one example, the apparatus 100 can be provided in place around a bed whilst the patient is still in the bed. This generally involves positioning the apparatus 100 adjacent the bed, and in particular adjacent an end corner of the bed. The frame 110 is then extended in a first direction perpendicular to a length of the bed, before being moved over the bed in a second direction parallel to the length of the bed. At this point, the frame 110 abuts a wall provided behind the bed. Following this, the frame 110 is extended in the second direction so that the frame extends generally around the bed, with the body 120 being supported by the frame 110 to define the internal volume 130 with the bed 131 contained therein. It will be appreciated that this process allows the apparatus 100 to be erected whilst the patient remains in situ, thereby further assisting with infection control.

An example process for erecting the apparatus 100 to isolate a patient bed will now be described in more detail with reference to FIGS. 5A to 5L.

For the purpose of this example, it is assumed that a patient is situated in a bed situated in a cubical on a hospital ward, and it is determined that there is a need to isolate the patient, for example, because the patient has been diagnosed with or is suspected of having an infection. In this scenario, the apparatus 100 would typically be provided on the ward to operate as an infection control or PPE trolley, as will be appreciated by persons skilled in the art.

Figure 5A:
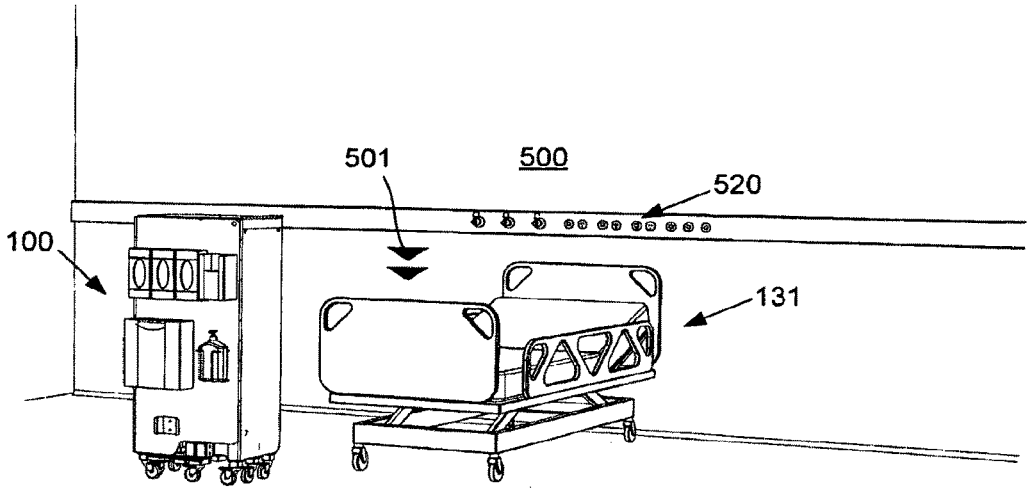
FIGS. 5A to 5L are schematic diagrams showing a method of erecting the apparatus of FIG. 1A to isolate a patient bed.
Figure 5B:
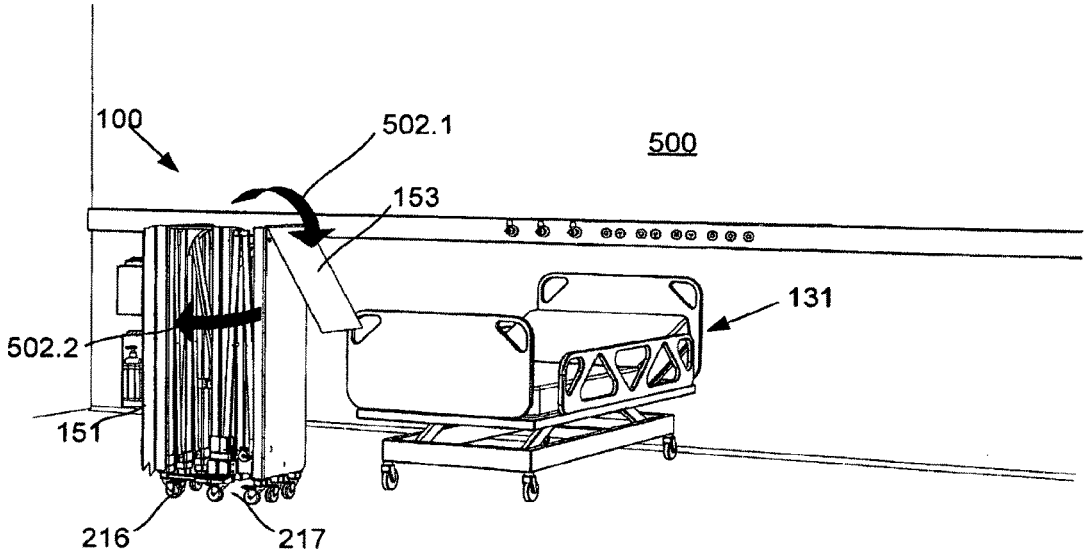
Figure 5C:
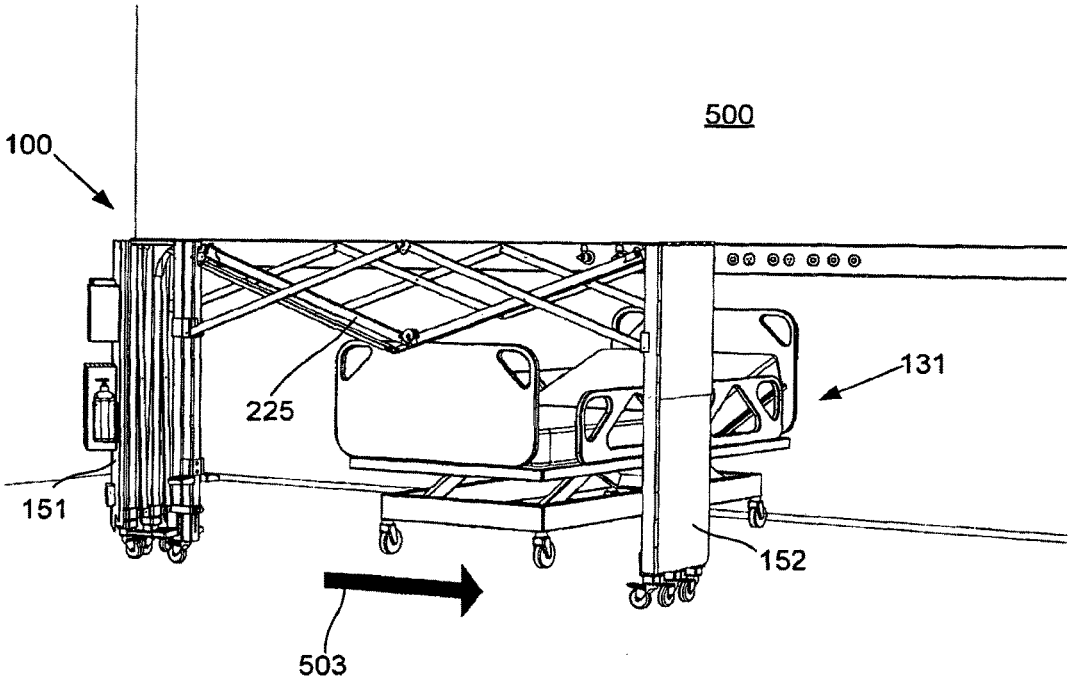
Figure 5D:
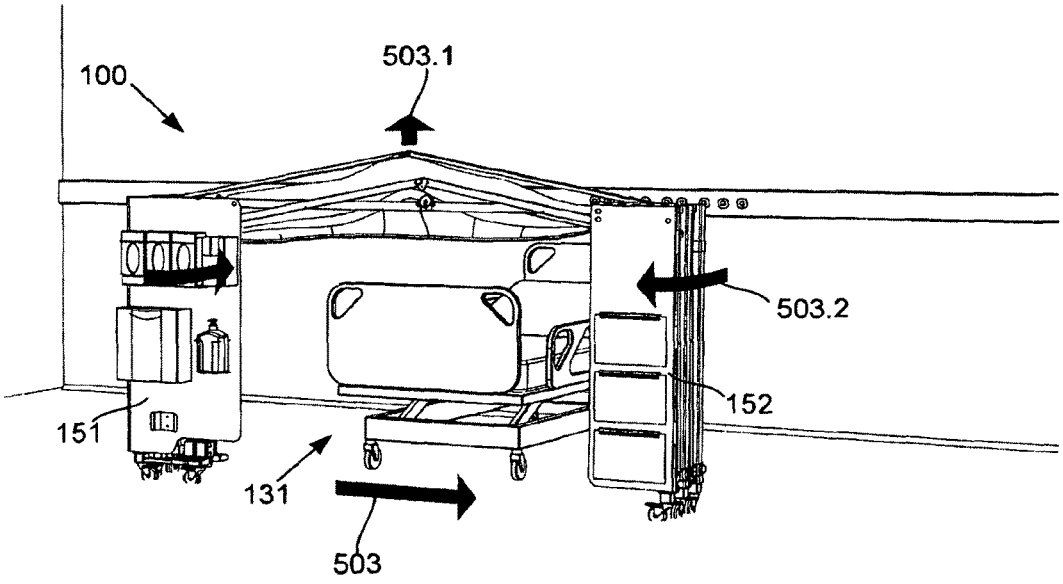
Figure 5E:
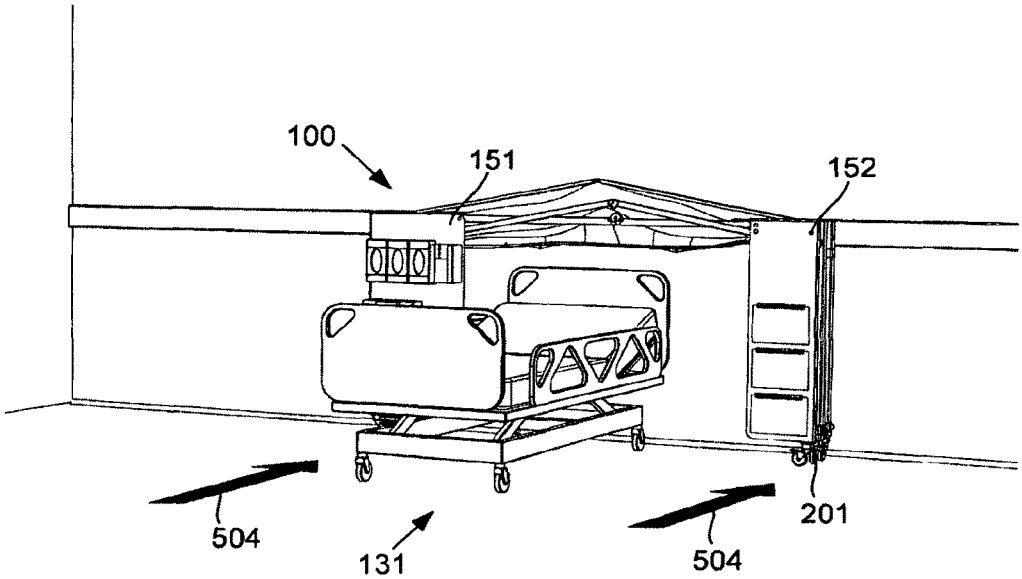

In this example, the apparatus 100 is conveyed in the storage configuration and positioned in front left corner of patient cubicle area, with the panel 151 facing away from the bed 131 and the cubicle wall 500, as shown in FIG. 5A. The bed 131 is lowered if necessary, as shown by the arrows 501, and at least one of the wheels 214, 215, 216, 217 on the left side of the frame 110 is optionally locked to hold the frame 110 in position during frame extension.

In one example, when the frame 110 is in the collapsed configuration, the panel 151 engages the frame 110 to lock the frame in position. Accordingly, the panel 151 can be opened by swinging the panel 151 outward, as shown by the arrow 502.2 in FIG. 5B, allowing the frame 110 to be erected. Additionally, the shelf 153 is hinged from the top of the frame 110 and rested against the panel 152, as shown by the arrow 502.1.

If not already fitted, the body 120 may be attached to the top of the frame 110, although the body could also be fitted later in the process, as will be mentioned below. This is achieved in any suitable manner, such as by attaching the cords or clips to fixing points on the frame 110. In one example, correct orientation of the body 120 can be assisted by matching colours on the clips and mounting points provided on the frame. The body can also be retained partially within packaging, so that the body remains in a raised position and remains predominantly sealed to maintain hygiene of the body 120.

Initially, the frame 110 is extended in the direction of arrow 503, by grasping and pulling one or more of the legs 201, 202, 203 and the panel 152. The frame is pulled across the width of the cubicle, so that the legs 201, 202, 203, 204, 205, 206, 207 are provided on either side of the bed. During this process, if the body 120 is fitted, it will unfold as the frame extends. Thus, during this process, the frame is extended widthwise, whilst remaining contracted in the lengthwise direction.

Once the frame is fully extended across the cubicle, the user typically checks the connecting members 222, 223 and the curtain rail 225 are fully extended and locked in position. The user can also urge the centre connecting member 226 upwards until it locks in position, as shown by the arrow 503.1, allowing the roof member 303 to be coupled thereto, if this has not already happened. By having the connecting member 226 raised above the level of the surrounding frame, this can lift the centre of the roof, providing additional space within the internal volume. After the roof member 303 is attached to the connecting member 226, any remaining connections between the upper part of the body 120, such as around the edge of the roof member 303, and the frame 110 are affected. The notice board panel 152 is also swung outwards from the engaging position shown in FIG. 5C to the open position shown in FIG. 5D, as shown by the arrow 503.2.

Next, all the wheels 211, 212, 213, 214, 215, 216, 217 are unlocked and the frame 110 is wheeled over the bed 131, as shown by the arrows 504, with the legs 201, 202, 203 and the legs 204, 205, 206, 207 straddling the bed 131.

If not already done, the frame 110 can then be moved into the raised position, for example by unlocking, raising and re-locking the telescopic legs 201, 202, 203, 204, 205, 206, 207. It will be appreciated that in the event that the telescopic legs are biased, the frame 110 may raise automatically as the legs 201, 202, 203, 204, 205, 206, 207 are unlocked. Alternatively, this may require that the frame is lifted by the user.

Figure 5F:
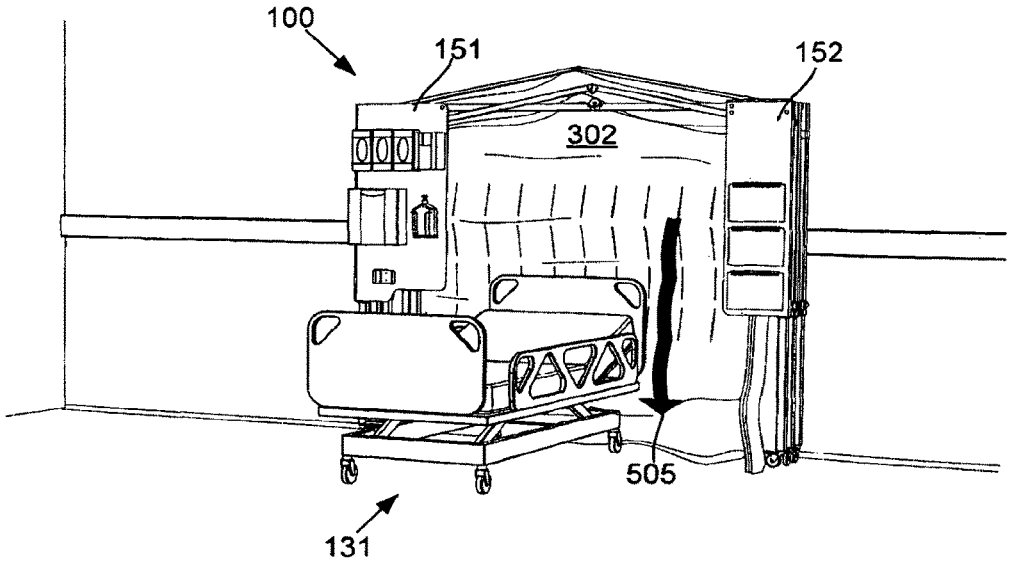

Once the frame 110 is raised and the legs 201, 202, 203, 204, 205, 206, 207 locked in the raised position the body 120 can be removed from any remaining packaging, or otherwise uncoupled, to allow it to unfold to the floor, as shown by the arrow 505 in FIG. 5F.

Figure 5G:
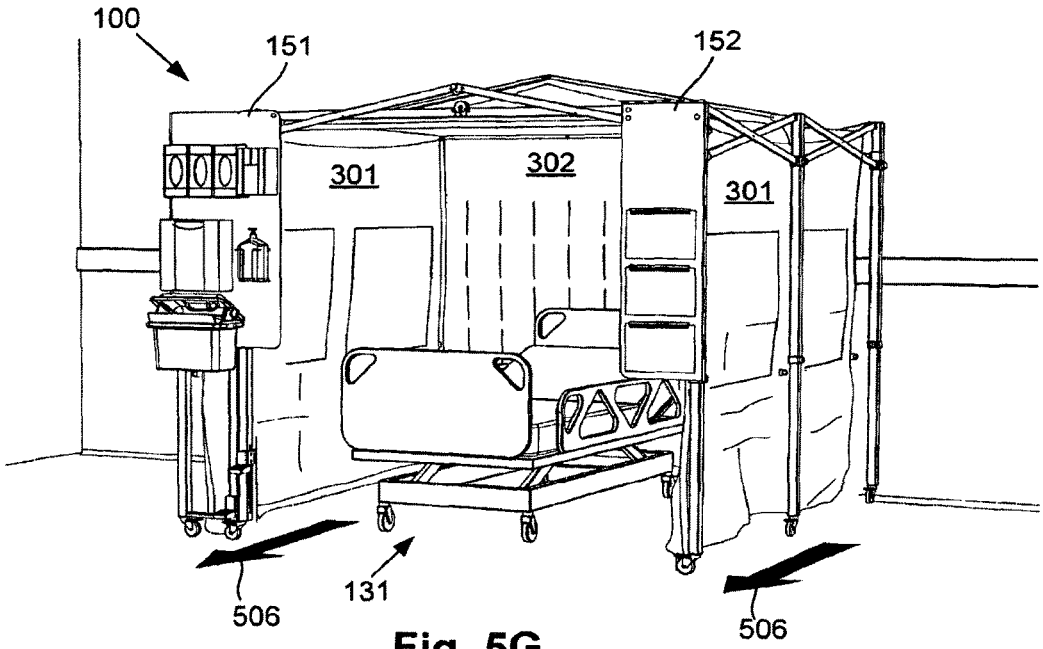

Next, the back corner wheels 201, 204 of the frame 110 which are closest to the cubicle wall 500 are locked, before the front of the frame 110 is then wheeled back over the bed 131, as shown by the arrows 506 in FIG. 5G, extending' the walls 301 of the body 120 around the bed 131, so that the frame is extended in the lengthwise direction. It will be appreciated that extending the frame separately in the widthwise and then subsequently in the lengthwise directions ensures that the frame 110 does not take up an undue amount of room on the ward during erection, making the isolation apparatus easier to erect even when space is limited. In this regard, traditional frames typically require that the frame is extended widthwise and lengthwise simultaneously, making these difficult to erect in the confined space of a ward or other indoor space.

The above described process also allows the frame 110 to be erected over the bed 131 whilst the patient remains in situ. This avoids the need to move the patient, which can increase the risk of infection to other individuals in the vicinity, as well as potentially adversely affecting the health of the patient At this point, the user checks that the connecting members 221, 224 are fully extended and optionally locked into position. The position of the frame 110 can be adjusted as necessary, before all of the wheels 211, 212, 213, 214, 215, 216, 217 are locked. If not already fitted, the body 120 may be attached to the frame 110, with the walls 301, 302 being dropped down into position as previously described.

Figure 5H:
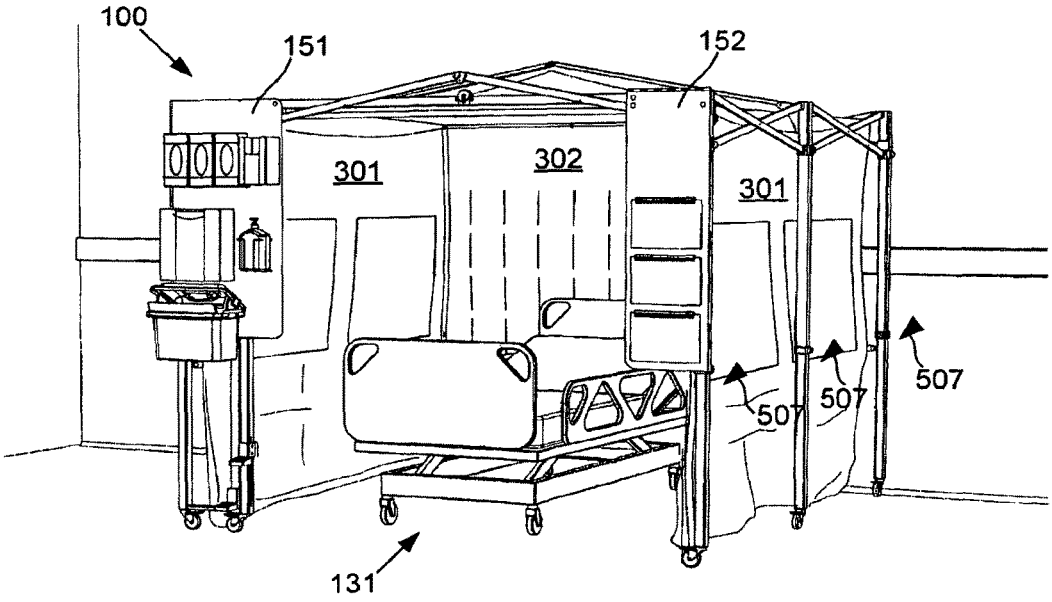
Figure 5I:
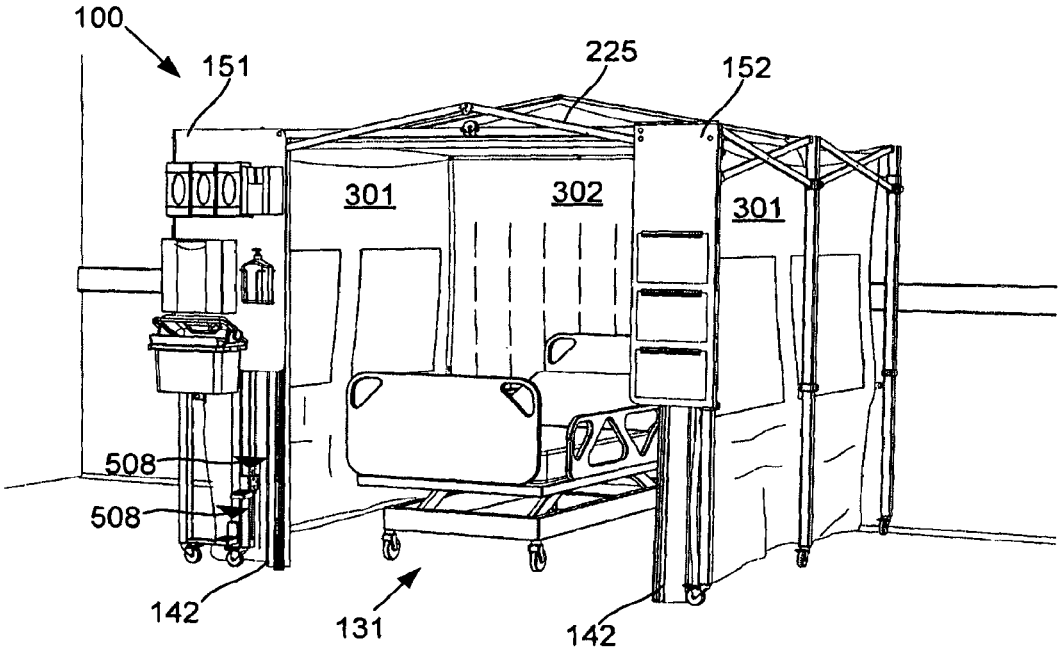

The walls 301 are attached to the legs 201, 202, 203, 204, 205, 206 of the frame 110 using provided fixings, as shown by the arrows 507 in FIG. 5H. Following this, the curtains 142 are attached to the curtain rail 225 and the foot pedals 141.1, 141.2, are pulled through slots in the body 120, as shown at 508, in FIG. 5I. The foot pedals 141.1, 141.2 are used to open and close the curtains 142 thereby engaging the magnetic coupling between the carriage system and the cable.

Figure 5J:
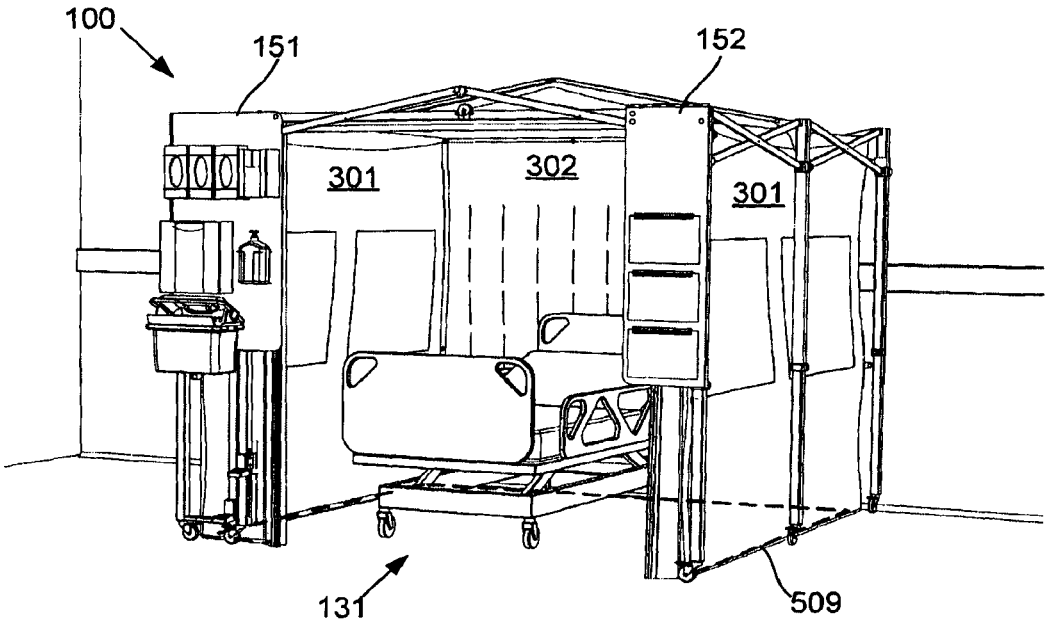

Typically, the side and rear walls 301, 302 (and any front wall member) may then be attached to the floor with double sided or otherwise attached adhesive tape, as shown at 509 in FIG. 5J. In one example, the adhesive tape is fixed to the walls of the body during manufacture, so that the user need simply remove a cover layer from the tape, and apply the tape directly to the floor.

Figure 5K:
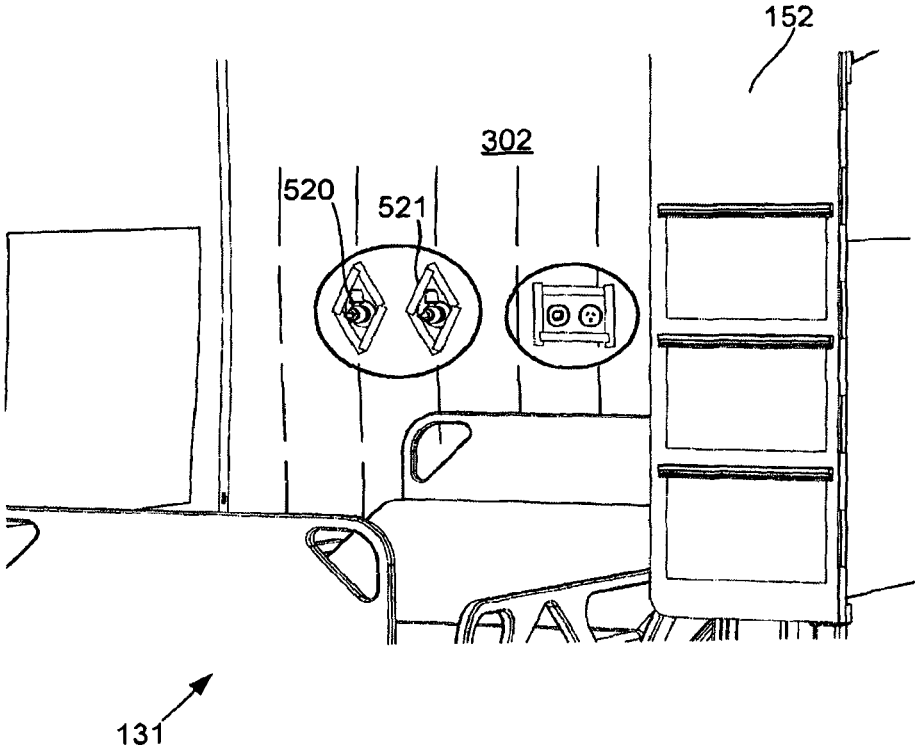

Connections to necessary equipment (e.g. wall, oxygen) 520 can be accessed through openings created using the perforations 302.1 in the rear wall of the body 120. Tape 521 may then be provided around the openings to limit transmission of infectious agents to ward wall surfaces, as shown in FIG. 5K.

It will be appreciated that whilst the above described method of erecting the apparatus is particularly beneficial, it is not intended to be limiting, and in practice any method for moving the apparatus into the operative configuration can be used. For example, the frame could be erected, before the frame is wheeled over the bed, should space permit. Additionally, the above described process has focussed on erection of the apparatus by a single person, but it will be appreciated that two or more people may be involved. This can make it easier, for example by avoiding the need to lock wheels to extend the frame, and raising the frame 110 on each side simultaneously.

Figure 5L:
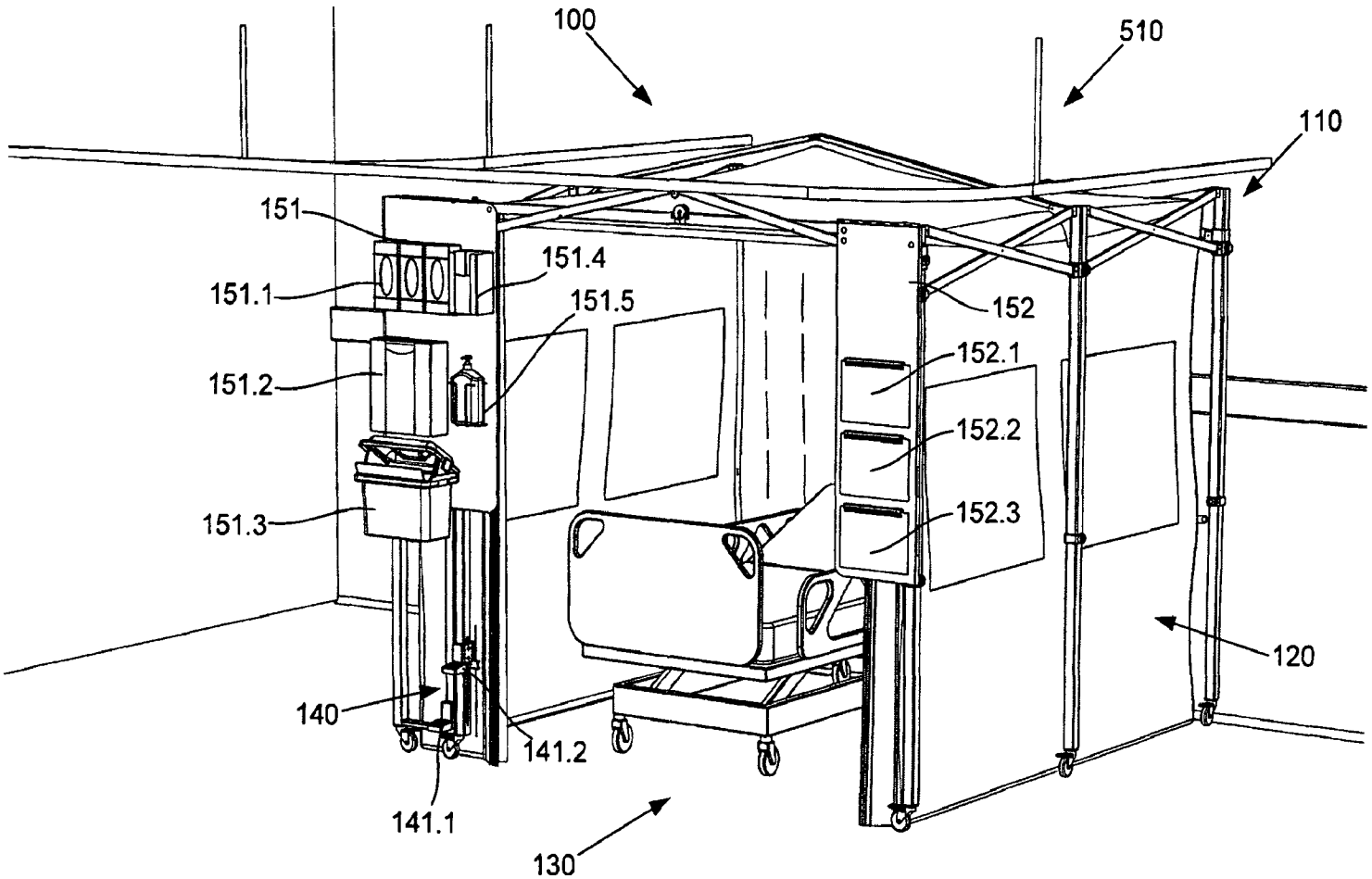

This results in a free standing, hands free opening, disposable isolation room, which in one example can easily be erected around a patient, in situ. Furthermore, as shown in FIG. 5L, the apparatus 100 can be sized for use in existing wards, fitting below in situ curtain rails 510, allowing the apparatus to be rapidly deployed in wide range of clinical settings. Additionally, the apparatus 100 can be used as a trolley to store medical items, or the like, for easy access.

Figure 6A:
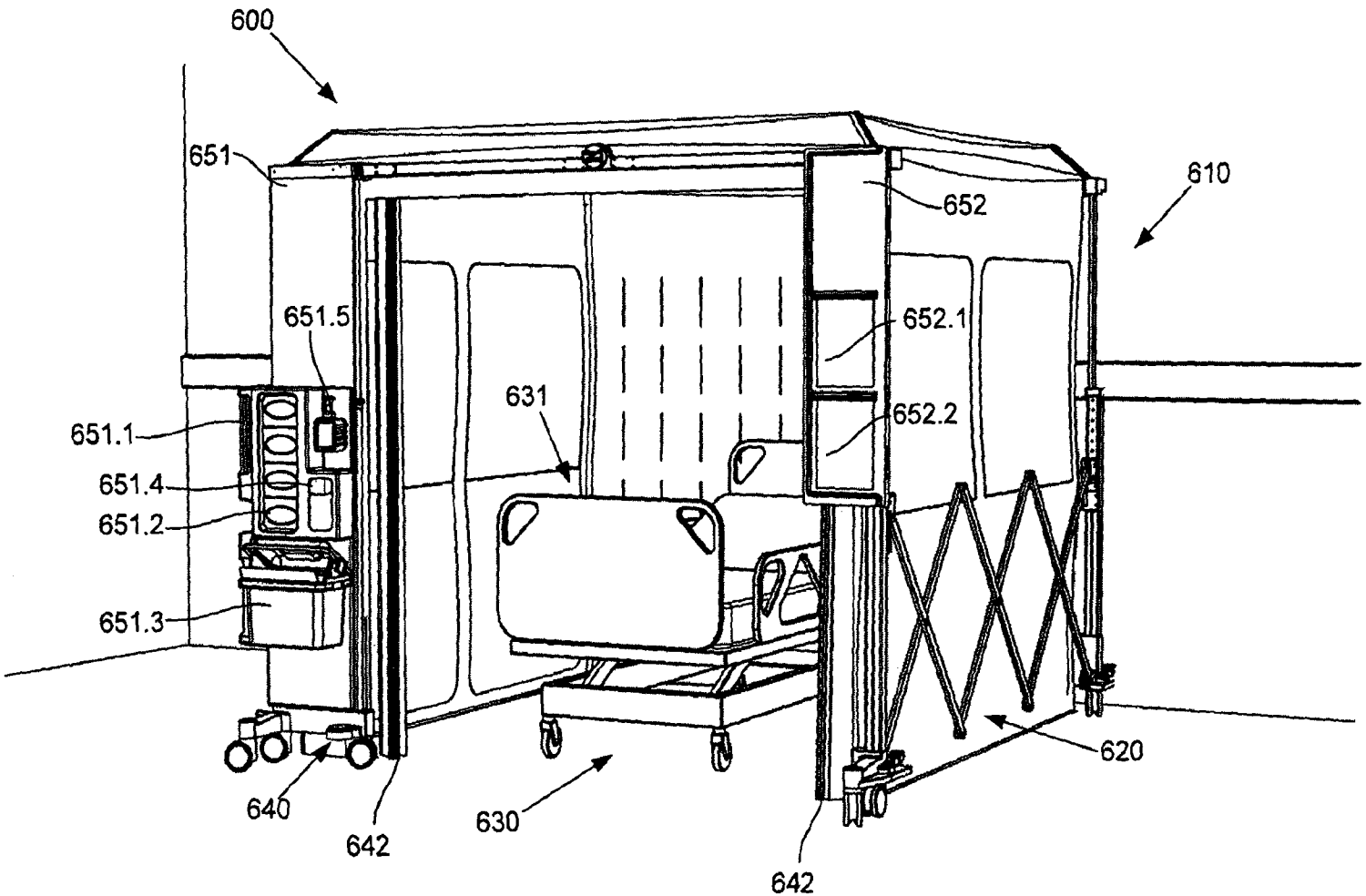
FIG. 6A is a schematic perspective view of a second example of apparatus for use in isolating a subject.
Figure 6B:
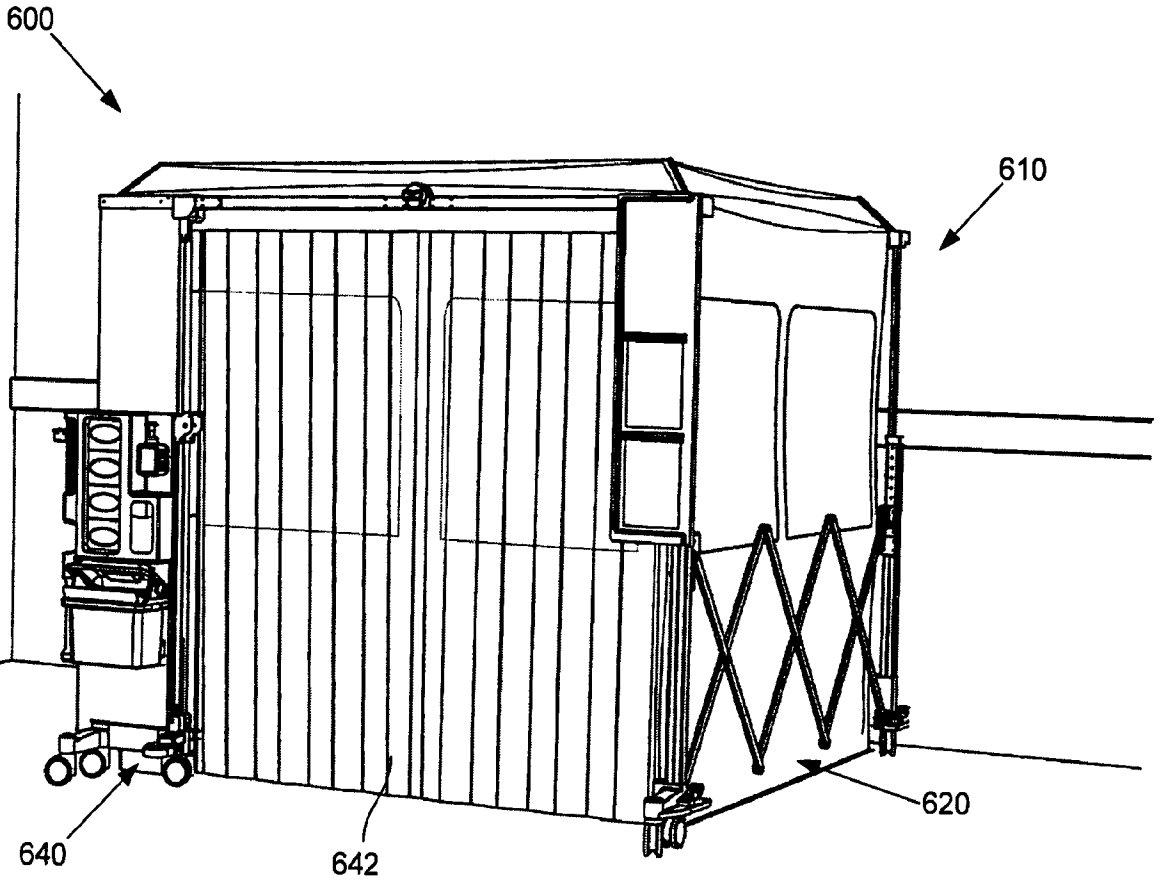
FIG. 6B is a schematic perspective view of the apparatus of FIG. 6A with a door in a closed position.
Figure 6C:
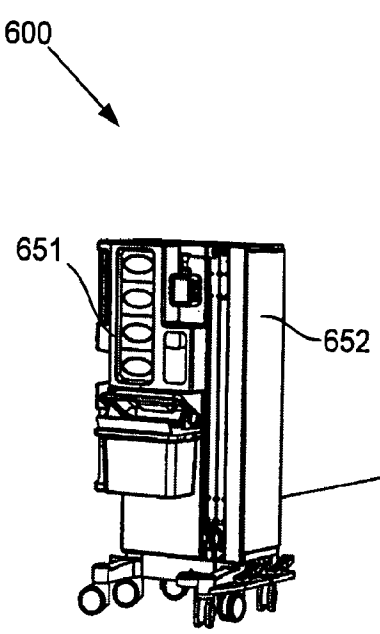
FIG. 6C is a schematic perspective view of the apparatus of FIG. 6A in a storage configuration.

A second example of an apparatus for use in isolating a subject, such as a patient, will now be described with reference to FIGS. 6A to 6C. In this example, the apparatus 600 is broadly similar to that described in the example of FIGS. 1A to 1D, and similar features are denoted by similar reference numerals increased by 500.

In this example, the apparatus 600 includes a frame 610, which in use is movable between collapsed and erected configurations. A body 620 is supported by the frame 610, so that when the frame 610 is in the erected configuration, the body 620 defines an internal volume 630 for containing a subject, such as a patient on a bed 631, to thereby substantially isolate the subject from a surrounding environment, such as a hospital ward or similar.

The apparatus 600 also typically includes a door actuator 640 supported by, and in particular mounted either to, or within, the frame 610. The door actuator 640 is for moving a door 642 between open and closed positions, as shown in FIGS. 6A and 6B, respectively. In the closed position, the door closes the internal volume, whilst in the open position the door provides access to the internal volume, thereby allowing users, such as medical practitioners to access the subject when required, while isolating the subject at other times. In this example, the door actuator is in the form of a button connected to an electronic control system that controls opening and closing of the door, for example, using an electrical motor or the like, thereby facilitating hands-free access to the internal volume 630. It will be appreciated that a similar button may also be provided on the inside of the frame, for opening and closing the door 642 from within the internal volume. However, this arrangement is not essential and other arrangements such as the cable driven foot pedal of the previous example could be used.

The apparatus 600 includes panels 651, 652, which include one or more mountings incorporated therein. The first panel 651 includes at least one mounting for receiving medical items, shown generally at 651.1, 651.2, 651.3, 651.4, 651.5, whilst the second panel 652 can act as a notice board, and can also include mountings (not shown) for receiving medical items or equipment.

When the apparatus 600 is in the operative configuration, the panels 651, 652 are arranged on either side of the door, thereby providing users easy access to stored items and information on the notice board. When the frame 610 is in the collapsed configuration shown in FIG. 6C, the panels can be provided on an outside of the frame 610, thereby allowing items to be retained mounted on the panels. This allows the apparatus to function as a trolley, allowing items and the apparatus 600 to be stored thereon, and moved around a medical facility as required. Furthermore, in this example, the first panel 651 is attached to the frame 610, so that when the frame is raised, the first panel 651 remains in a lowered position, and a similar arrangement may also be used for the notice panel 652, so that this remains in a lowered position when the frame 610 is raised. It will be appreciated that this reduces the weight of the frame 610 that needs to be lifted, as well as helping maintain a lower centre of gravity, which improves stability.

It will therefore be appreciated that otherwise the operation of the apparatus 600 is substantially similar to that of the apparatus 100 described above, and this, will not therefore be described in detail.

An example of the frame 610 will now be described in more detail with reference to FIGS. 7A to 7E.

In this example, the frame 610 includes five upright legs 701, 702, 703, 704, 705, interconnected by three lateral connecting members 721, 722, 723 and a collapsible curtain rail 725 that extends across a front of the frame 610 to support the curtains 642, in use. The leg 705 is coupled to the leg 704, by the first panel 651 and a secondary panel 708, extending laterally between the legs 704, 705. The leg 705 is positioned between the legs 702, 704, extending partially across a front of the frame 610 to thereby provide additional support for the door 642, as well as to support the door actuator 640.

Figure 7A:
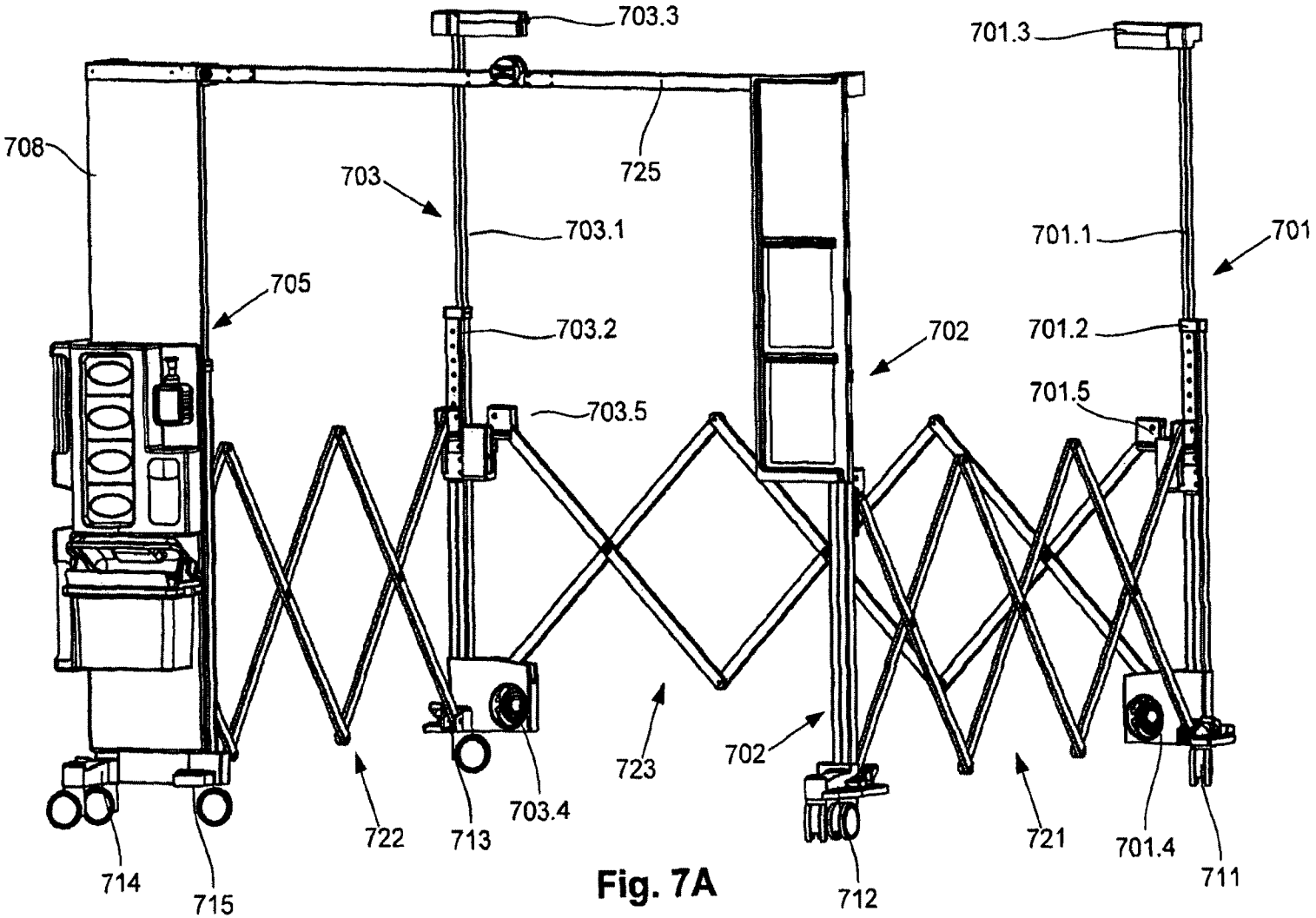
FIG. 7A is a first schematic perspective view of an example of the frame of the apparatus of FIG. 6A in an erected configuration.
Figure 7C:
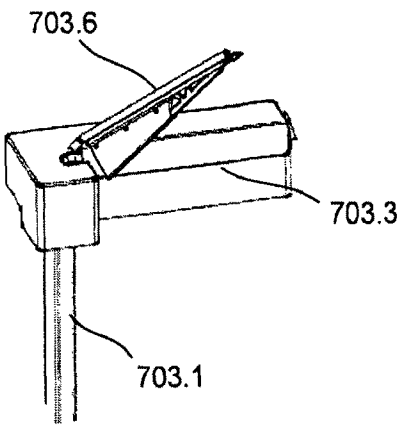
FIG. 7C is a schematic perspective view of one of the roof supports of FIG. 7B.
Figure 7B:
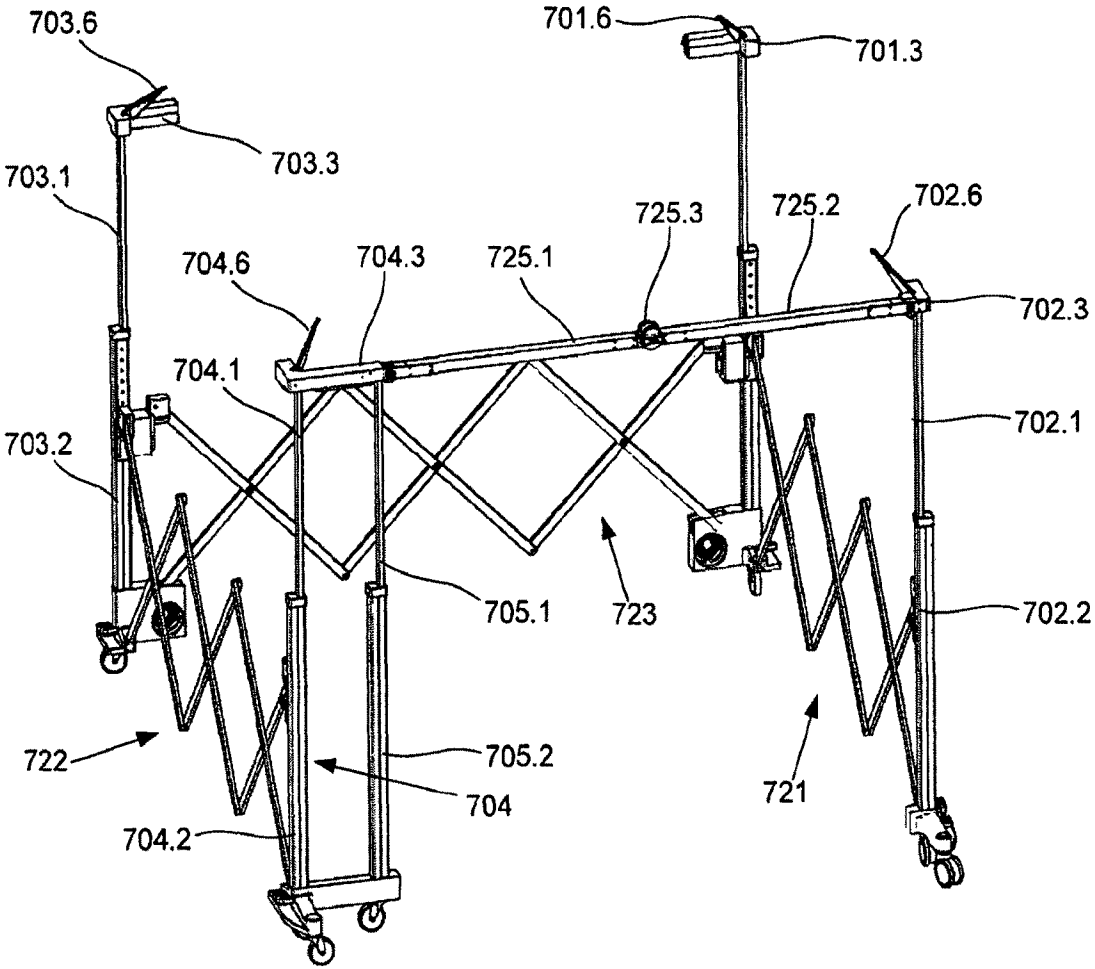
FIG. 7B is a second schematic perspective view of an example of the frame of the apparatus of FIG. 6A in an erected configuration.
Figure 7D:
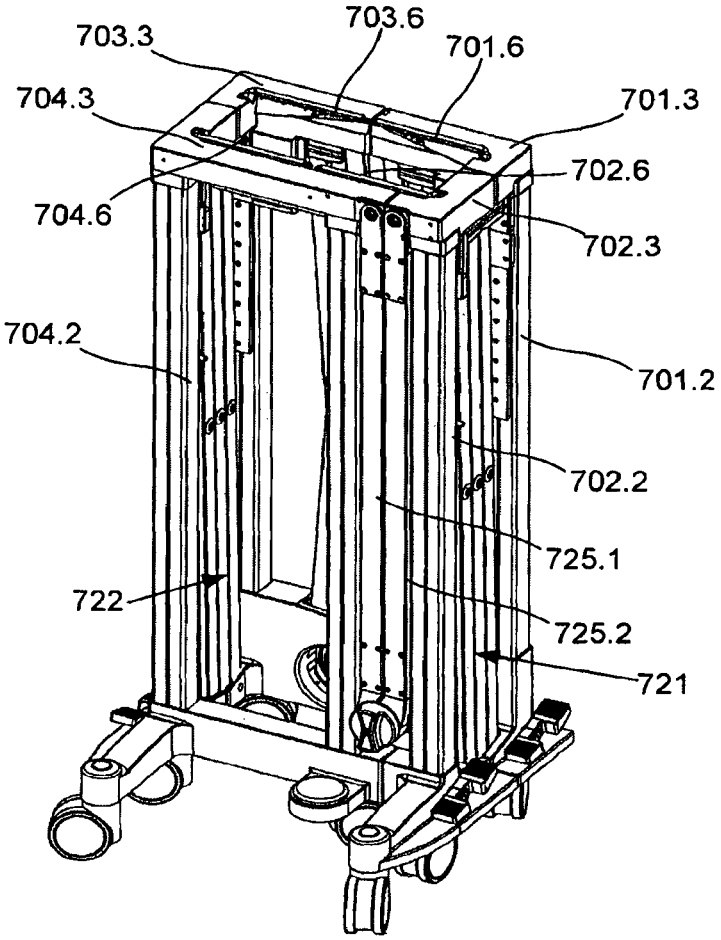
FIG. 7D is a schematic perspective view of the frame of FIG. 7A in a collapsed configuration.

The legs 701, 702, 703, 704, 705, may be made of multiple sections 701.1, 701.2, 702.1, 702.2, 703.1, 703.2, 704.1, 704.2, 705.1, 705.2, and are telescopic and optionally biased, allowing the frame 610 to be moved between a raised position, shown for example in FIG. 7A, and lowered position, shown for example in FIG. 7D. In this example, the panel 651 is attached to lower portions 704.2, 705.2 of the legs 704, 705, whilst the secondary panel 708 is attached to upper sections 704.1, 705.1 of the legs 704, 705. As a result of this configuration, the first panel 651 that supports medical equipment remains in a lowered position, whilst the secondary panel 708 is raised. This minimises the weight that needs to be raised, whilst ensuring that legs 704, 705 are interconnected along their length, thereby improving structural rigidity.

The connecting members 721, 722, 723 include pairs of pivotally connected scissor arms attached to the legs 701, 702, 703, via fixed and movable brackets allowing the scissor arms to move between an extended position, shown for example in FIG. 7A, and retracted positions, shown for example in FIG. 7D. The legs 701, 703 include 701.4, 701.5, 703.4, 703.5 shrouds for receiving ends of the connecting member 722, when in a retracted position. Lower shrouds 703.4, 701.4 may also support fan/filter arrangements for filtering air exiting or entering the internal volume 630.

However, in this example, in contrast to the apparatus 100, the connecting members 721, 722, 723 are mounted to the leg lower sections 701.2, 702.2, 703.2, 704.2, 705.2, so that the connecting members 721, 722, 723 are not raised as the legs are raised into the raised position. This helps maintain a lower centre of gravity, and provides additional stability in use. Despite this, once the body 620 is fitted, the combination of the body 620 and collapsible curtain rail 725 can help ensure the frame 610 has sufficient structural rigidity.

It will be noted that in one example, the scissor arms of the connecting members 721, 722, 723, on adjacent sides of the frame are independent, meaning the frame can be expanded in first and second orthogonal directions independently. For example, the frame can be extended widthwise and then subsequently extended lengthwise, as will be described in more detail below.

The collapsible curtain rail 725 typically includes two rail members 725.1, 725.2, having first ends hingably coupled to the frame 610, for example to the legs 702, 705, and second ends interconnected by a hinge 725.3. The rail can incorporate a cable opening/closing mechanism, similar to that described above with respect to the apparatus 100, although alternative arrangements can be used. A specific example curtain rail including such an alternative arrangement will be described in more detail below.

The frame 610 typically includes groups of one or more wheels 711, 712, 713, 714, 715, mounted on respective legs 701, 702, 703, 704, 705, and can be of any suitable form such as lockable castor wheels, or the like, allowing the frame 610 to be movably or fixedly supported on a surface.

Figure 7E:
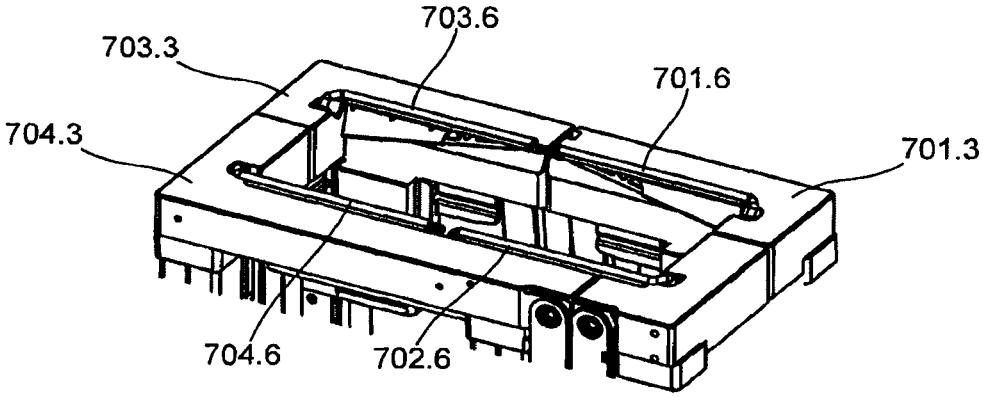
FIG. 7E is a schematic perspective view of the roof supports of FIG. 7D in a retracted configuration.

In this example, the legs 701, 702, 703, 704 include a top piece 701.3, 702.3, 703.3, 704.3, that in use receives roof supports 701.6, 702.6, 703.6, 704.6, for supporting a roof of the body 620. The roof supports 701.6, 702.6, 703.6, 704.6, typically form part of the roof. If the body is installed when the frame is in a collapsed configuration, the roof supports would be pivotally biased towards a retracted position, as shown in FIGS. 7D and 7E. However, when the frame is in an erected configuration shown in FIGS. 7B and 7C, the body applies a force to the roof supports, so that the roof supports pivot into the raised position as shown. It will be appreciated that biasing of the roof supports towards the retracted position tensions and hence supports the roof in use, whilst also raising the roof to increase the height of the internal volume.

Figure 8A:
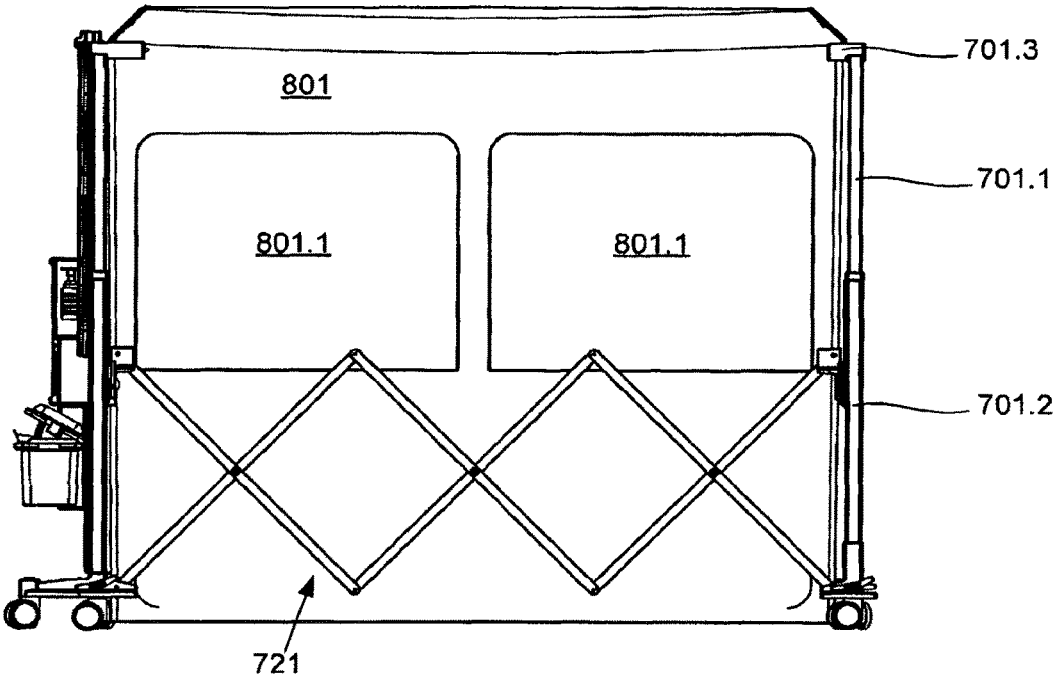
FIG. 8A is a schematic side view of the apparatus of FIG. 6A.
Figure 8B:
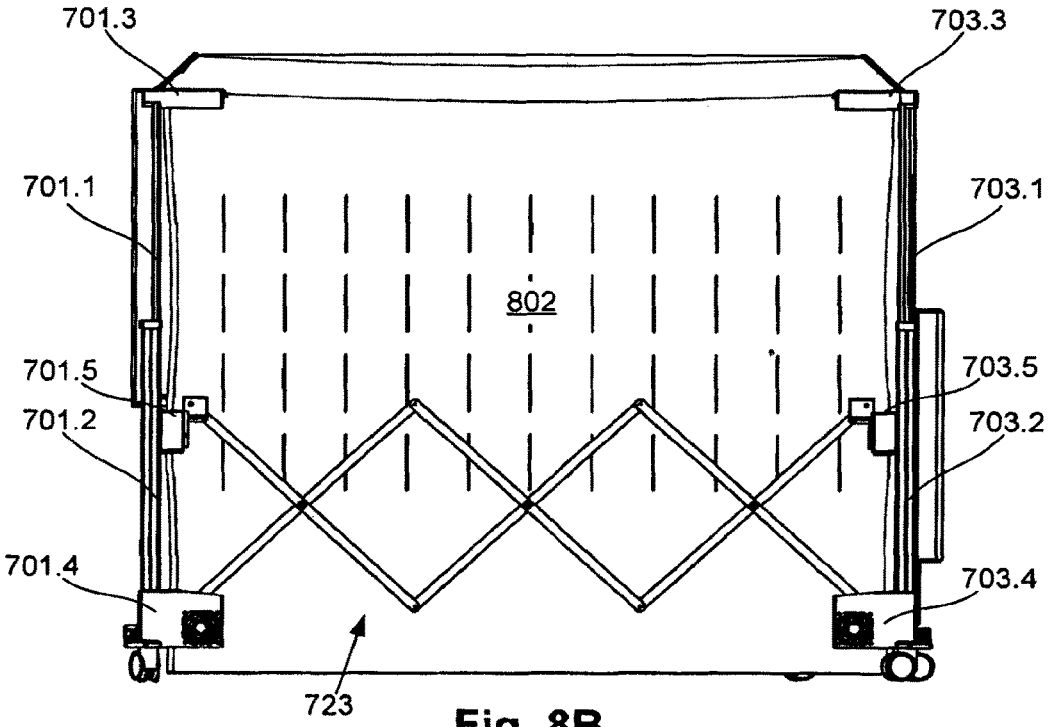
FIG. 8B is a schematic rear view of the apparatus of FIG. 6A.
Figure 8C:
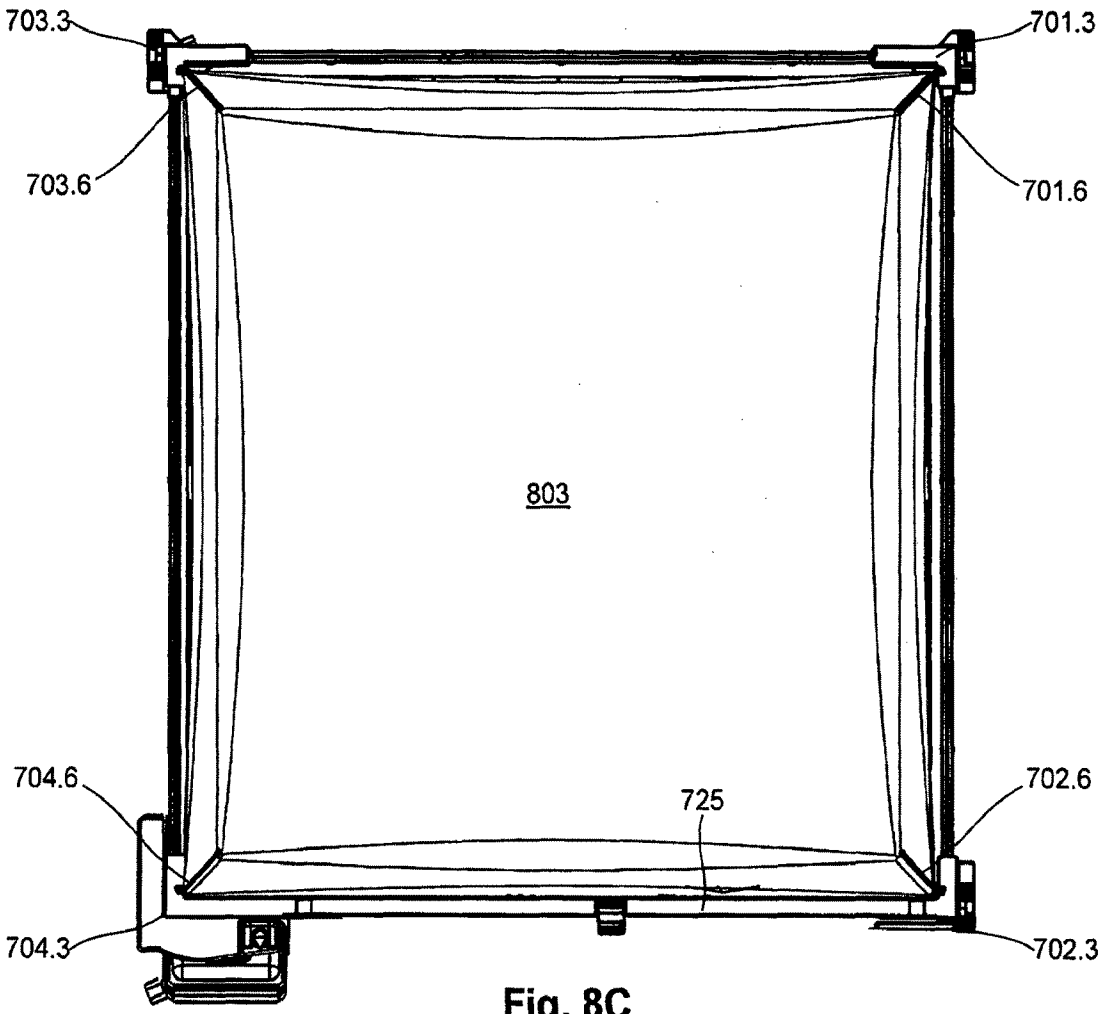
FIG. 8C is a schematic plan view of the apparatus of FIG. 6A.

In this regard, as shown in FIGS. 8A to 8C, the body 620 typically includes a roof member 803 and a number of walls 801, 802 extending between a supporting surface and the roof member 803 when the apparatus 600 is in the operative configuration.

The body 620 is substantially similar to the body 120. However, in this example, the roof 803 the roof supports 701.6, 702.6, 703.6, 704.6 are attached to corners of the roof as show, for example using fasteners or the like. However it will be appreciated that alternatively other arrangements could be used, for example by having the roof supports mounted to the frame and then removably attached to the roof in use. When the body 620 is fitted to the frame 610, the roof supports 701.6, 702.6, 703.6, 704.6 are coupled to the top pieces 701.3, 702.3, 703.3, 704.3, with the roof supports 701.6, 702.6, 703.6, 704.6 being biased to thereby tension and raise the roof, and hence help support the roof, when the roof is in an erected configuration.

The process for erecting the apparatus 600 to isolate a patient bed is substantially similar to that of the apparatus 100 and will not therefore be described in detail. However, some of the key stages will be described with reference to FIGS. 9A to 9E.

The bed 631 is initially moved outwardly from the wall 900. The body 620 is coupled to the frame by inserting the roof supports 701.6, 702.6, 703.6, 704.6 into the top pieces 701.3, 702.3, 703.3, 704.3. The apparatus 600 is moved near the wall 900, next to the bed, with the wheels outermost from the bed being locked and the legs 701, 702, 703, 704, 705 raised, as shown by the arrow 901.

The frame 610 is then extended in the direction of arrow 902, by pulling the legs 701, 702, so that the frame 610 extends between the bed 631 and the wall 900. It will be appreciated that the frame 610 must be extended behind the bed first so that the connecting member 723 can be position between the bed 631 and wall 900. During this process, the curtain rail 725 unhinges and once the frame is fully extended, the user can check the connecting member 723 and the curtain rail 725 are fully extended and locked in position, as shown at 903. If the body 620 is fitted, it can then unfold as shown by the arrow 904 so it passes between the bed 613 and the wall 900. The notice board panel 652 is also swung outwards as shown by the arrow 905. Next, the wheels 712, 714, 715, are unlocked and the frame 610 is wheeled over the bed 631, as shown by the arrows 906, making sure the connecting members 721, 723 are full extended and locked in position.

Figure 9A:
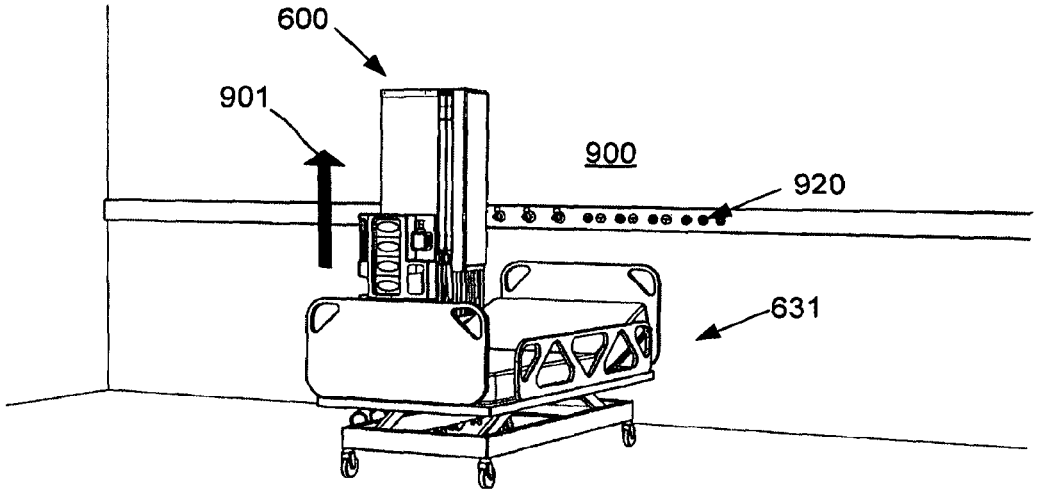
FIGS. 9A to 9E are schematic diagrams showing a method of erecting the apparatus of FIG. 6A to isolate a patient bed.
Figure 9B:
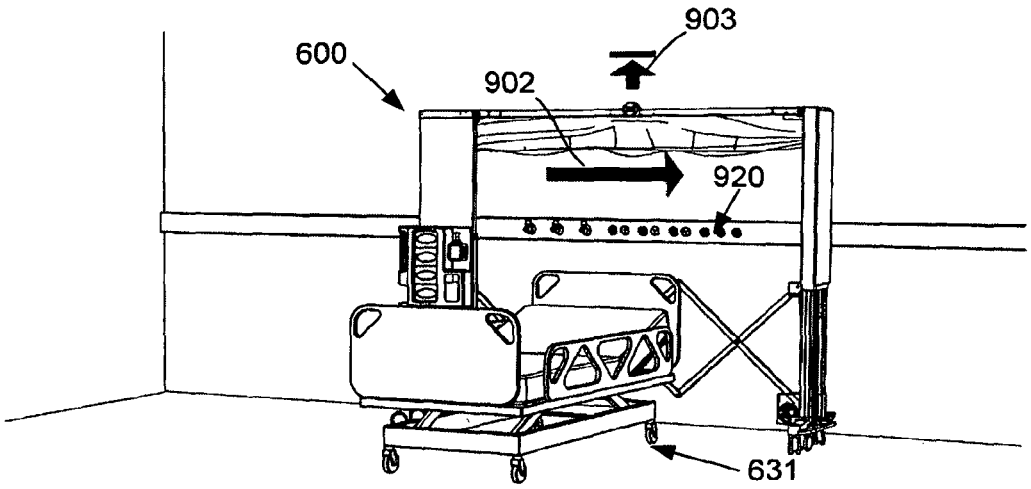
Figure 9C:
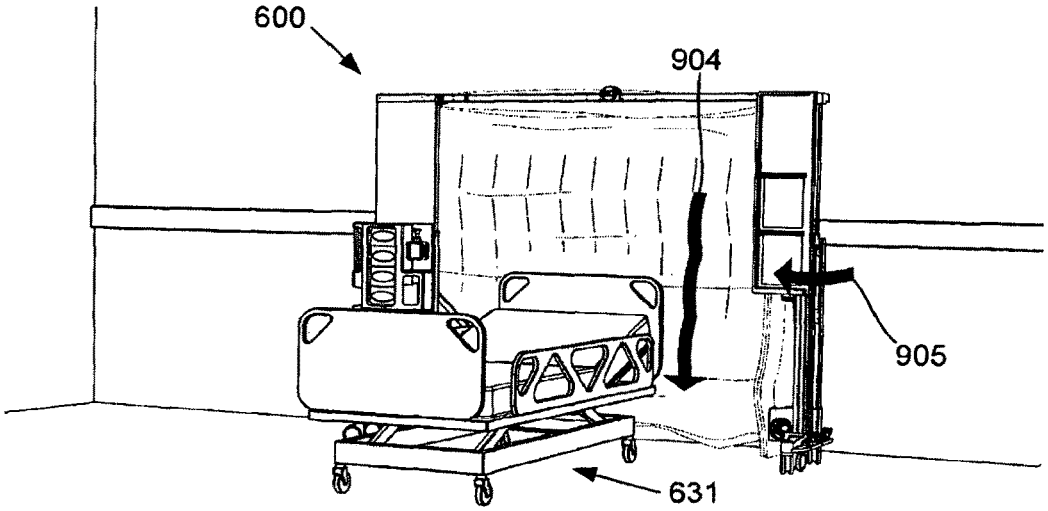
Figure 9D:
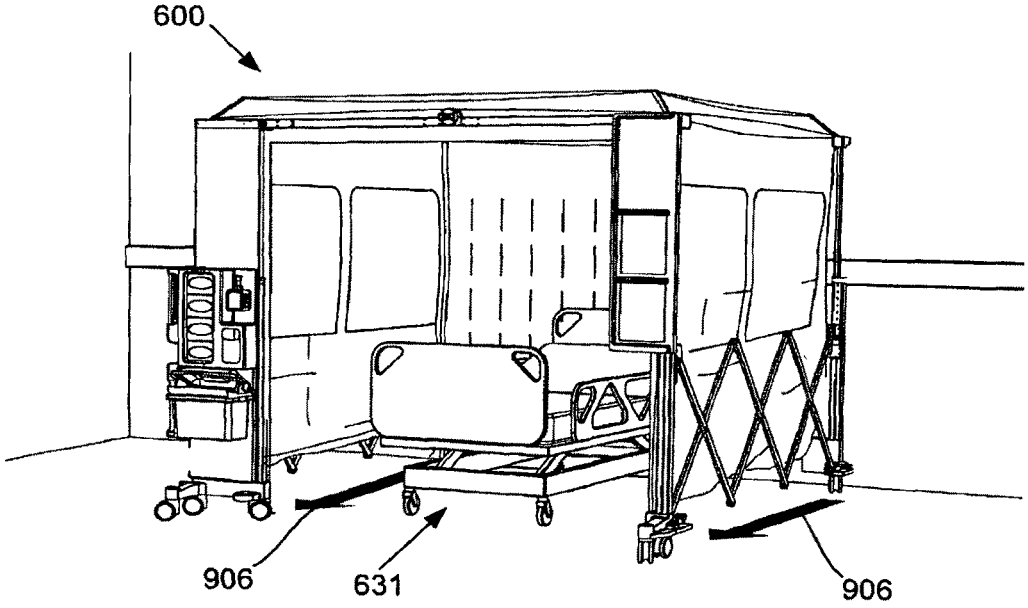
Figure 9E:
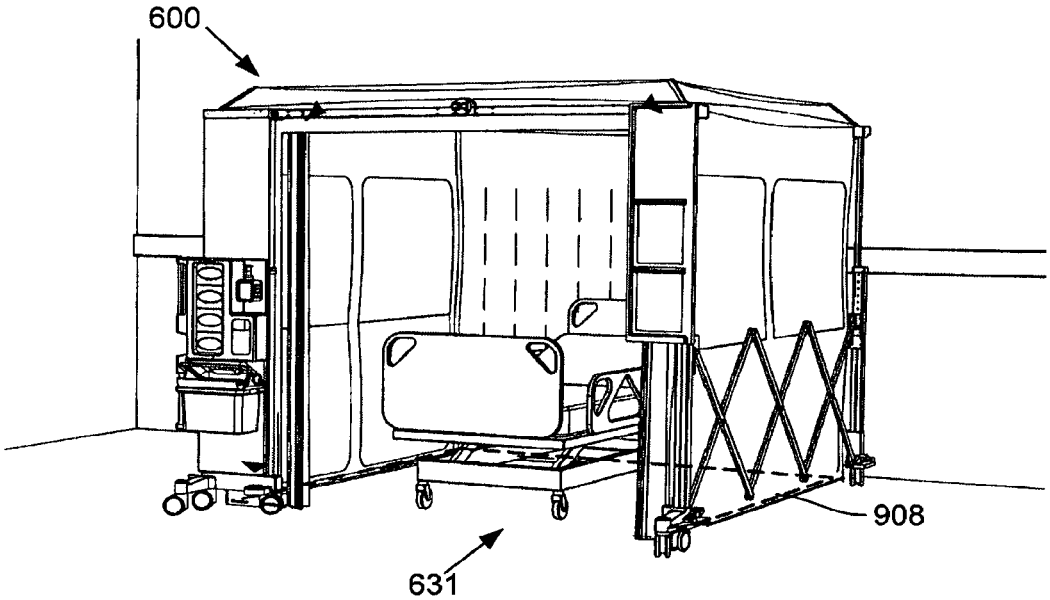

The body 620 can be secured to the legs 701, 702, 703, 704, before the side and rear walls 801, 802 are attached to the floor with double sided or otherwise attached adhesive tape, as shown by the dotted line 908 in FIG. 9E. In one example, the adhesive tape is fixed to the walls of the body during manufacture, so that the user need simply remove a cover layer from the tape, and apply the tape directly to the floor. Following this, the curtains 642 are attached to the curtain rail 725 and connections to necessary equipment (e.g. wall oxygen) 920 can be accessed through openings created using perforations in the rear wall of the body 620.

The above described process also allows the frame 610 to be erected over the bed 631 whilst the patient remains in situ. This avoids, the need to move the patient, which can increase the risk of infection to other individuals in the vicinity, as well as potentially adversely affecting the health of the patient.

The above examples have focussed on the provision of an isolation apparatus, which is directed towards isolating a subject particularly in respect of touch and droplet types of infection transmission. However, this is not essential and the apparatus can be extended in order to provide protection against airborne transmission, thereby acting an as Airborne Infectious Isolation Room (AIIR).

In order to provide protection against airborne transmission, it is typical to provide an air filtering system, for example, using a HEPA filter, to thereby filter air extracted from the internal volume, and typically provide the internal volume at a negative pressure (i.e. at a lower pressure than the outside environment). It will be appreciated that a negative pressure can be maintained even if the internal volume is not hermetically sealed, by provided sufficient sealing and continuous pumping of air from within the internal volume. In one example, a negative pressure can be achieved if the walls of the body are sealed to the floor using adhesive tape, or similar.

An anteroom may also be provided adjacent the doorway, to provide further sealing, as well as to provide a location in which contaminated materials, such as clothing or the like, can be removed and retained. In one example, an anteroom can be provided by attaching two of the isolation apparatuses together. For example, the rear wall of a first apparatus may be removed, and then positioned adjacent the front wall of a second apparatus containing the patient. In this example, the first apparatus acts as an anteroom, whilst the second apparatus acts as the isolation room.

The first and second apparatus can be attached in any suitable manner, and in one example, this is achieved using a joiner strip that has double sided tape running around each side of the joiner strip. This seals each isolation room together so that the overall arrangement includes both an isolation room and anteroom.

It will be appreciated however that other arrangements could be used, such as for the first apparatus to be custom apparatus having a smaller overall size, allowing this to function solely as an anteroom. Alternatively, a separate door arrangement, similar to that of the current isolation apparatus could be used to seal-off part of a corridor, or for a number of other uses.

In one example, such a separate curtain rail apparatus can include legs supporting to a hingeable curtain rail, the rail including two rail members having first ends hingably coupled to the legs and second ends interconnected via a hinge. The hinge can include a locking mechanism to lock the rail in an operative position. The hinge may be of any suitable form, but in one example, includes first and second body portions and wherein the locking mechanism includes locking bolts for selectively engaging the first and second body portions to thereby lock the hinge.

Each rail member can enclose an endless belt mounted on sprockets positioned at either end of the rail member, the sprockets at the second end of each rail being mechanically interconnected by an idler gear, and the sprocket at the first end of one of the rail members being connected to an electric motor, thereby allowing the belts to be moved, and wherein in use a curtain is mechanically coupled to each belt so that movement of the belt allows the curtains to be opened or closed.

An example of a stand alone curtain rail will now be described in more detail with reference to FIGS. 10A to 10F.

Figure 10A:
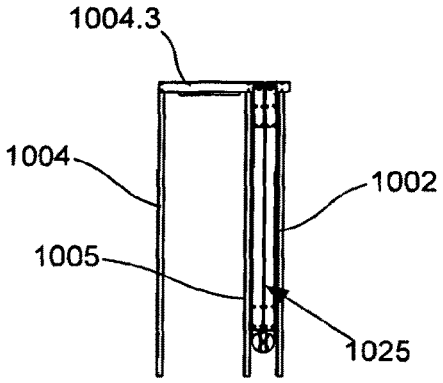
FIG. 10A is a schematic front view of an example of a curtain rail apparatus in a collapsed configuration.
Figure 10B:
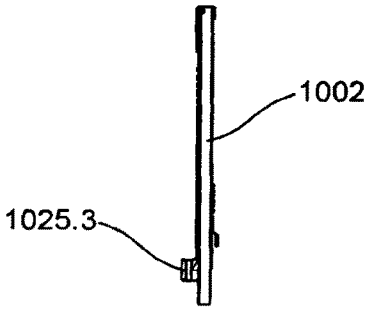
FIG. 10B is a schematic end view of the curtain rail apparatus of FIG. 10A in the collapsed configuration.
Figure 10C:
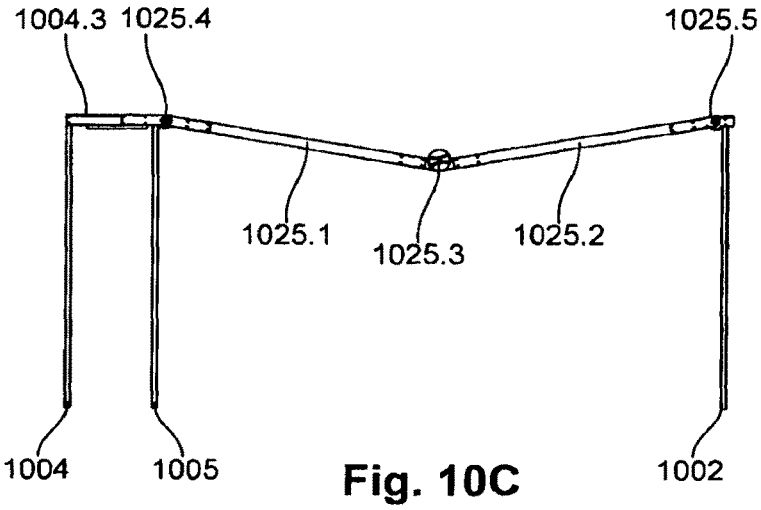
FIG. 10C is a schematic front view of the curtain rail apparatus of FIG. 10A in a partially erected configuration.
Figure 10D:
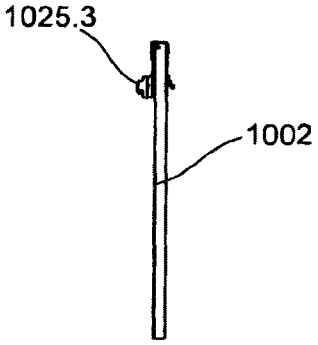
FIG. 10D is a schematic end view of the curtain rail apparatus of FIG. 10A in the partially erected configuration.
Figure 10E:
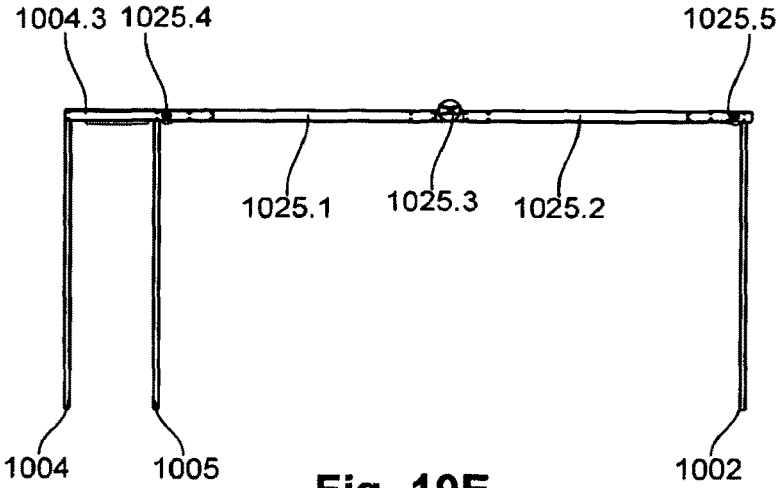
FIG. 10E is a schematic front view of the curtain rail apparatus of FIG. 10A in an erected configuration.
Figure 10F:
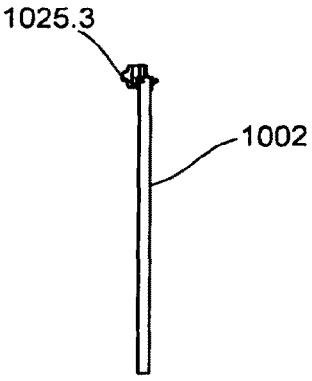
FIG. 10F is a schematic end view of the curtain rail apparatus of FIG. 10A in the erected configuration.
Figure 10G:
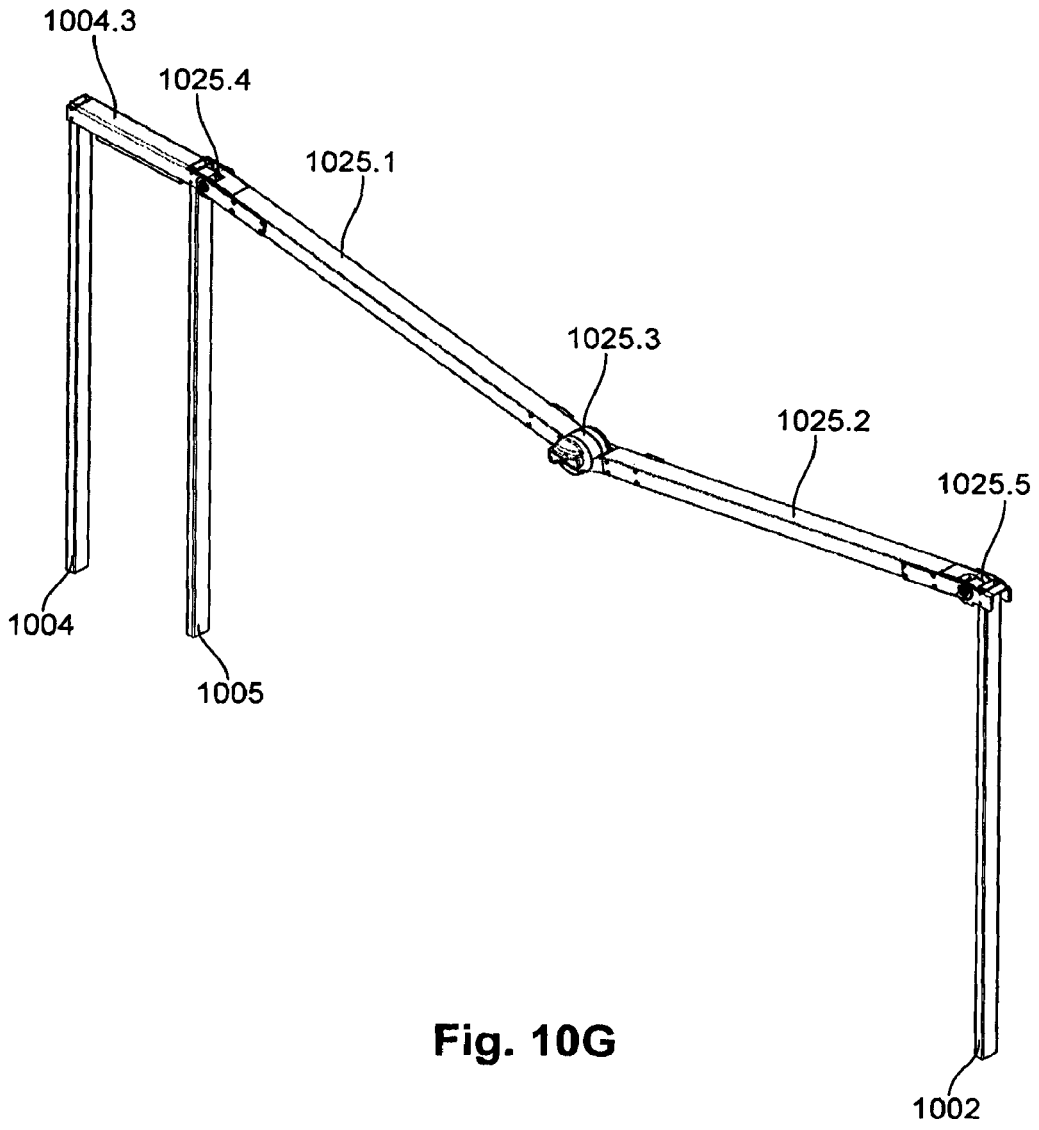
FIG. 10G is a schematic perspective view of the curtain rail apparatus of FIG. 10A in the partially erected configuration.
Figures 11A, 11B:
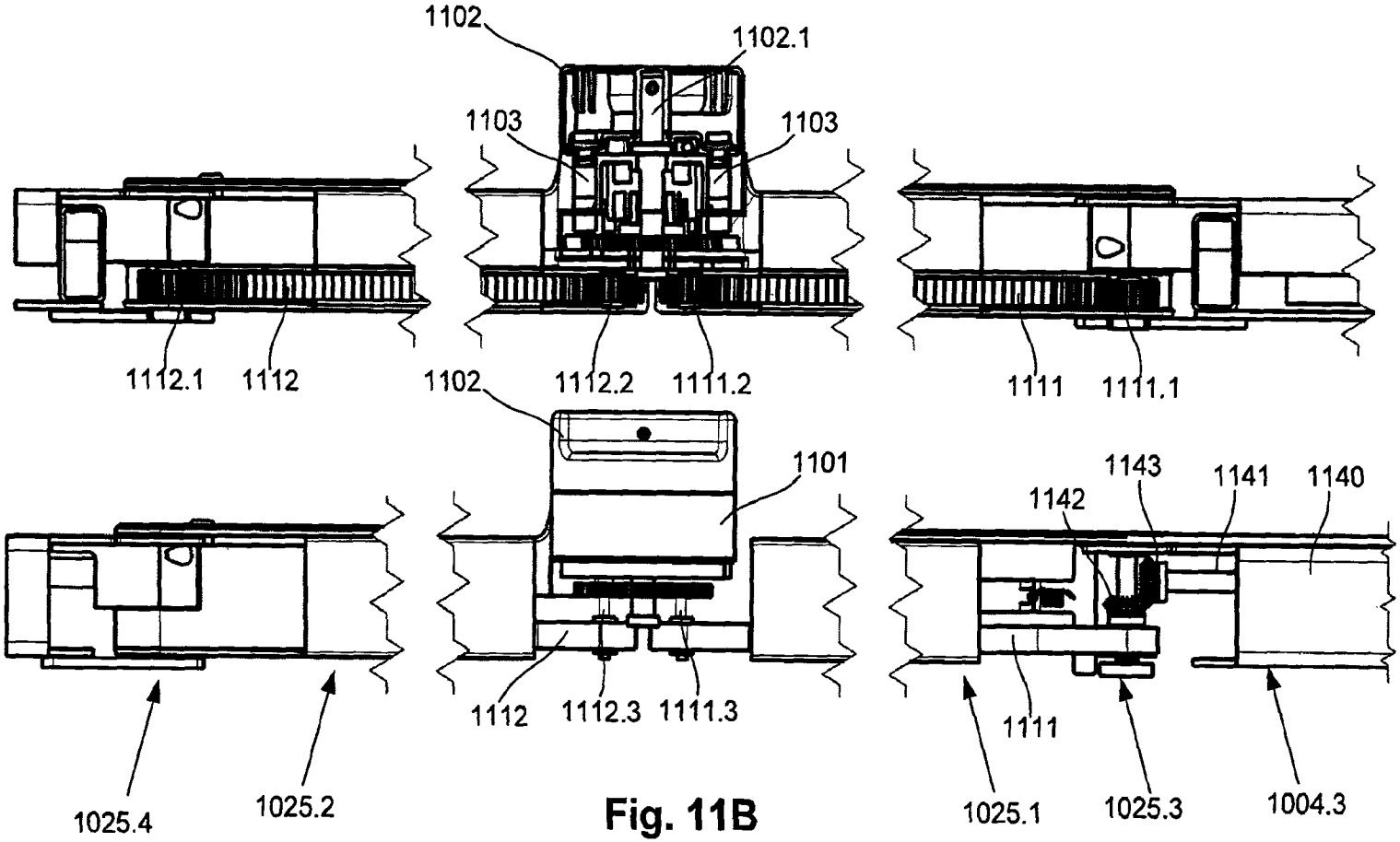
FIG. 11A is a schematic cross sectional view of an example of a curtain rail.
FIG. 11B is a schematic plan view of the curtain rail of FIG. 11A (with some parts hidden for clarity)
Figure 11C:
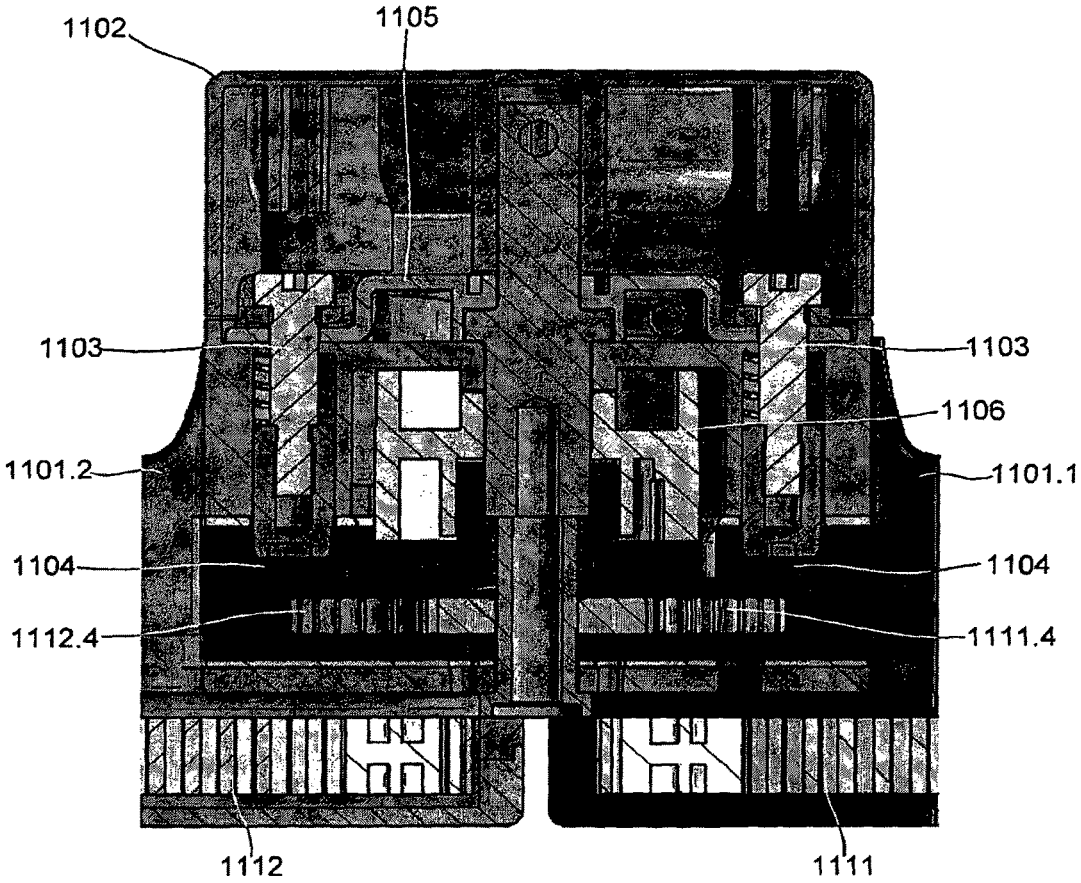
FIG. 11C is a schematic cross sectional view of the hinge of the curtain rail of FIG. 11A.
Figure 11D:
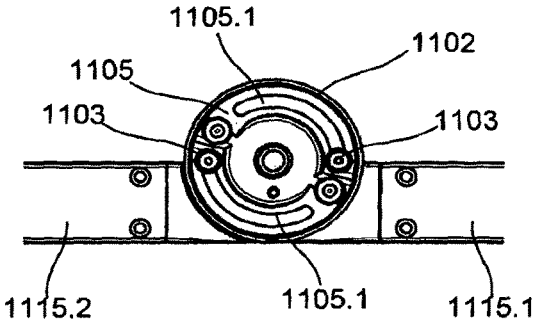
FIG. 11D is a schematic front view of the plate of the hinge of FIG. 11C (with some parts hidden for clarity)
Figure 11E:
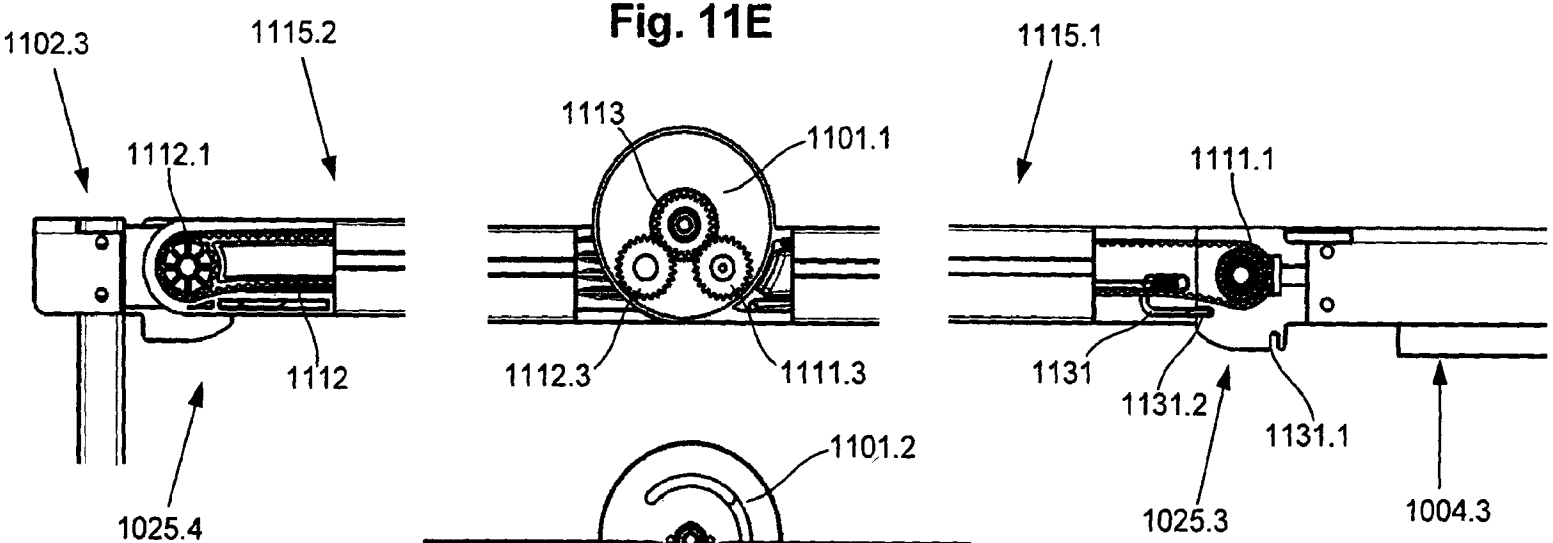
FIG. 11E is a schematic back view of the curtain rail of FIG. 11A (with some parts hidden for clarity); and, FIG. 11F is a schematic back view of the hinge of FIG. 11A (with some parts hidden for clarity).
Figure 11F:
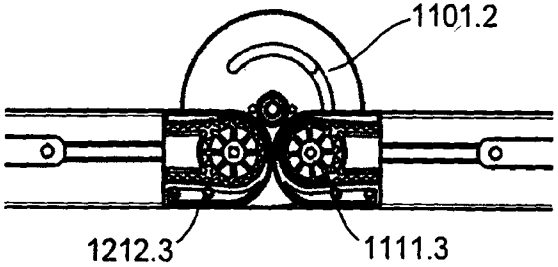

In this example, the curtain rail 1025 is supported by legs 1002, 1004, 1005, with the legs 1004, 1005 being interconnected by a top piece 1004.3. The curtain rail 1025 includes two rail members 1025.1, 1025.2, having first ends coupled to the frame legs 1005, 1002, via hinges 1025.4, 1025.5 and second ends interconnected by a hinge 1025.3. As shown in FIGS. 10A, 10C and 10E, the legs 1002, 1005 can be moved apart so that the rail moves from the retracted position shown in FIG. 10A to an erected configuration shown in FIG. 10E.

It will be appreciated that in this example, the legs 1002, 1004, 1005 may be telescopic, allowing the curtain rail to be supported at any appropriate height. The telescopic legs 1002, 1004, 1005 can therefore be of similar form to the legs of the frames 110, 610, and could therefore be biased, for example using gas struts, spring mechanisms, counterweights or the like, to at least partially support the weight of the rail and hence make the rail easier to raise. Furthermore, it will be appreciated that the length over which the rail extends (corresponding for example to the width of corridor that can be spanned) can be adjusted for example through use of a telescopic section or scissor members connecting legs 1004, 1005, and/or replacing top piece 1004.3 to allow variations in overall length.

Once erected, a curtain can be fitted to the rail, with an actuator being used to allow hands free operation of the door. It will be appreciated that this arrangement can be used to span a corridor or the like, thereby allowing isolation of an area to be provided.

In one example, the rail incorporates a cable opening/closing mechanism, similar to that described above with respect to the apparatus 100 and 600. However, alternatively an electric motor and suitable controller, or other similar arrangement can be used. A specific example will now be described in more detail with reference to FIGS. 11A to 11F.

In this example, the hinge 1025.3 includes a body 1101 including two body portions 1101.1, 1101.2, each of which is coupled to a respective rail member 1025.1, 1025.2, and a handle 1102. A plate 1105 and reel 1106 are positioned between the handle 1102 and body 1101, with the handle 1102, plate 1105 and reel 1106 being fixed to the shaft 1102.1, which is rotatably mounted within the bodies 1101.1, 1101.2, thereby allowing relative rotation of the body portions 1101.1, 1101.2 and handle 1102, whilst the plate 1105 and reel 1106 remain fixed relative to the handle 1102.

The hinge 1025.3 further includes locking bolts 1103, mounted in apertures 1105.1 in the plate 1105. The plate 1105 is profiled so that as the handle 1102 and hence plate 1105 are rotated, the bolts 1103 are urged in an axial direction. The bolts extend through the second body portion 1101.2, allowing the bolts 1103 to move into or out of recesses 1104 in the first body portion 1101.1 thereby selectively locking or unlocking the first and second body portions 1101.1, 1101.2 and hence the hinge 1025.3. The reel 1106 is coupled via a cable, linkage, chain, belt, or the like, (not shown) to a locking plate 1131, which selectively engages one of the locking apertures 1131.1, 1131.2 in the hinge 1025.3, thereby locking the hinge 1025.3 in either the retracted or extended positions. It will be noted that a locking plate 1131 would typically be provided on both rail members with locking apertures in both the hinges 1025.3, 1025.4, and that this is only shown for one rail member and hinge 1025.3 for clarity only. When the hinge 1025.5 is unlocked, the cable is wound in on the reel 1106, thereby retracting the locking plate 1131, and releasing the hinge 1025.5, allowing the rail to be extended.

The rail member 1025.1, 1025.2 contain endless belts 1111, 1112 mounted on respective sprockets 1111.1, 1111.2, 1112.1, 1112.2 at either end. The sprockets 1111.1, 1112.1 are axially aligned with the hinges 1025.3, 1025.4. The sprockets 1111.2, 1112.2 are coupled via axles 1112.3, 1111.3 to respective cogs 1112.4, 1111.4, which are in turn connected by an idler cog 1113 rotatably mounted on the shaft 1102.1. This arrangement allows rotation to be transmitted between the sprockets 1111.2, 1112.2, and hence the belts 1111, 1112, so that the belts move in synchronisation.

The sprocket 1111.1 is mechanically coupled via right angle gears 1142, 1143, to a shaft 1141, which is in turn coupled to a motor 1140, allowing the belts to be driven. It will be appreciated that carriages can be driven by the belts 1111, 1112, allowing the curtains to be opened and closed by appropriate movement of the belts 1111, 1112. In this regard, the curtains would be connected to the rail via a suitable carriage or other connector (not shown), which is in turn coupled to a corresponding one of the belts 1111, 1112, so that movement of the belts allow the curtains to be opened or closed, thereby providing a doorway, which can be opened and closed using hands-free operation of a sensor or switch coupled to the motor. It will be appreciated that edges of the curtain or a flexible skirt attached to the curtain and/or the frame may be fixed to walls and/or a ceiling and/or floor of the corridor, using adhesive tape, a mechanical beam, or other fixing mechanism, thereby helping to provide an isolation barrier across the corridor.

Thus, by having a curtain rail 1025 extend across the corridor, the rail being supported on either side by respective legs 1022, 1024, 1025, this provides a barrier within the corridor. The use of two such barriers can allow part of the corridor to be closed off, so that this can function as an anteroom, or alternatively, the curtain apparatus of FIGS. 10A to 10G could be used in conjunction with the apparatus 100 or apparatus 600, to act as an anteroom.

It will be appreciated that the above described curtain apparatus could have a number of uses in addition to spanning a corridor, and could be used in any situation in which a curtain is required, irrespective of whether isolation is required. For example, this could be used to provide a temporary changing room by extending the curtain rail across a corner of a room or similar. Additionally, the collapsible curtain rail could be used as part of an exhibition stand, where a curtain is used, but it is also necessary to be able to easily pack and transport the curtain rail. It should therefore be understood that the curtain rail can be used in a variety of situations and need not be limited to use in isolating subjects or equipment.

It will also be appreciated that the hinge and drive mechanism of FIGS. 11A to 11F can be used in the examples above as the rails 225, 725 of the apparatus 100 and 600 respectively. Thus, in this instance, the curtains 142, 642 can be operated using the motor 1140, using appropriate controls.

Whilst the above description has focussed on isolating a patient having an infection, it will be appreciated that the system could also be used in other scenarios, for example to isolate immune deficient patients from surrounding patients, or the like. In one example, when isolating a patient to prevent the patient being exposed to potential infectious materials, the patient could be provided in the isolation apparatus. In a further example, this could be positively pressurised relative to the surrounding environment, thereby providing a hygienic environment within the enclosed space which excludes external contaminants e.g. for the purpose of conducting work or procedures, although it will be appreciated that pressurisation is not essential, and at least some isolation will be provided irrespective of whether pressurisation is used.

Throughout the above description a number of features have been described in a single example. However, it will be appreciated that the different features could be used independently, and that their use in conjunction, whilst beneficial, is not necessarily essential.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The term subject will be understood to apply to any entity that it is to be isolated and that this can include patients, as well as other individuals. The subject can also be a non-human subject such as an animal, including but not limited to, primates, livestock, performance animals, such as race horses, or the like. In addition to this, the isolation apparatus could also be used for equipment or other items, for example in case these have been exposed to contaminants. Thus, even when a patient is removed from the isolation apparatus, it will still continue to isolate any equipment contained therein, for example until this can be cleaned and/or disposed of. The term subject should therefore encompass any item and not be limited to a biological entity, even though it will be appreciated that the above described techniques are particularly advantageous for use with biological entities.

Persons skilled in the art will appreciate that numerous variations and modifications will become apparent. All such variations and modifications which become apparent to persons skilled in the art, should be considered to fall within the spirit and scope that the invention broadly appearing before described.

Whilst the above example has focussed on use of the isolation apparatus in isolating a subject in the form of a patient, it will be appreciated that the above described arrangement can be used whenever any form of isolation is required. For example, the isolation apparatus could be used to provide a portable spray painting booth, which could be erected or positioned around an object or article to be painted, with the apparatus acting to support spray painting equipment when provided in the trolley configuration. In this instance, the apparatus is still used in isolating a subject, in the form of an object or article, preventing spray paint from impinging on the surrounding environment. Thus, it will be appreciated that the apparatus can be used in a wide range of circumstances and can be used for isolating any object or article, and that specific reference to patients as a preferred example, is not intended to be limiting.

The claims defining the invention are as follows:

1. A method of erecting apparatus for use in isolating a subject, the apparatus including a collapsible frame including a number of upright legs and a number of lateral connecting members interconnecting the legs, the connecting members including scissor arms movable between retracted and extended positions, the scissor arms on adjacent sides of the frame being independent, and the method including:

a) providing the apparatus adjacent a bed;

b) extending the collapsible frame in a first direction transverse to a length of the bed so that legs are provided on both sides of the bed; and, c) subsequently extending the collapsible frame in a second direction extending along the length of the bed so that the frame is extended over the bed with the legs straddling the bed, and so that a body supported by the frame defines an internal volume for containing a subject to thereby substantially isolate the subject from a surrounding environment.

2. A method according to claim 1, wherein the legs include lockable wheels, and wherein the method includes selectively locking the wheels of the frame to hold the frame in position during frame extension.

3. A method according to claim 1, wherein the method includes attaching the body to the frame to define the internal volume.

4. A method according to claim 3, wherein the method includes attaching the body to a top of the frame before extending the frame.

5. A method according to claim 1, wherein the frame includes a locking mechanism, and wherein the method includes releasing the locking mechanism.

6. A method according to claim 1, wherein when the frame is in a collapsed position, at least one panel engages the frame and wherein the method includes opening the panel by swinging the panel outward to allow the frame to be extended.

7. A method according to claim 1, wherein the legs are telescopically extendable, and wherein the method includes moving the frame into a raised position using telescopic legs.

8. A method according to claim 1, wherein the method includes attaching at least one curtain to a rail wherein the rail is hinged and unhinges as the frame is extended.

9. A method according to claim 8, wherein the method includes using a door actuator to open and close the at least one curtain to thereby engage a coupling between a carriage system supporting the at least one curtain and a belt or cable of the door actuator.

10. A method according to claim 1, wherein the method includes attaching walls of the body to a floor using an adhesive.

11. A method according to claim 10, wherein the method includes attaching walls of the body to a floor using a double sided adhesive tape.

12. A method according to claim 1, wherein the method includes;

a) accessing at least one connection to equipment via at least one opening in a wall, or roof of the body, the at least one opening being created using perforations in the wall or roof of the body; and, b) taping edges of the at least one opening to a surface against which the opening abuts.

13. A method according to claim 1, wherein the method includes:

a) moving the bed outwardly from a wall;

b) coupling the body to the frame;

c) extending the frame in the first direction so that the frame extends between the bed and the wall;

d) unfolding the body so that the body passes between the bed and the wall;

e) extending the frame over the bed;

f) securing the body to the legs of the frame;

g) attaching side and rear walls of the body to the floor with adhesive tape; and, h) attaching curtains to a curtain rail.

14. A method of erecting apparatus for use in isolating a subject, the method including:

a) providing the apparatus adjacent a bed;

b) extending a collapsible frame in a first direction transverse to a length of the bed;

c) extending the collapsible frame in a second direction extending along the length of the bed so that a body supported by the frame defines an internal volume for containing a subject to thereby substantially isolate the subject from a surrounding environment; and, d) attaching at least one curtain to a rail wherein the rail is hinged and unhinges as the frame is extended.

15. A method according to claim 14, wherein the method includes using a door actuator to open and close the at least one curtain to thereby engage a coupling between a carriage system supporting the at least one curtain and a belt or cable of the door actuator.

16. A method of erecting apparatus for use in isolating a subject, the method including:

a) providing the apparatus adjacent a bed;

b) moving the bed outwardly from a wall;

c) coupling a body to a collapsible frame;

d) extending the collapsible frame in a first direction transverse to a length of the bed so that the frame extends between the bed and the wall;

e) unfolding the body so that the body passes between the bed and the wall;

f) extending the collapsible frame in a second direction extending along the length of the bed so that the frame is extended over the bed;

g) securing the body to legs of the frame;

h) attaching side and rear walls of the body to the floor with adhesive tape; and, i) attaching curtains to a curtain rail, wherein the body supported by the frame defines an internal volume for containing a subject to thereby substantially isolate the subject from a surrounding environment.

* * * * *